US012178282B2

(12) United States Patent
Sakamoto et al.

(10) Patent No.: US 12,178,282 B2
(45) Date of Patent: Dec. 31, 2024

(54) SHOE SOLE AND SHOE

(71) Applicant: ASICS CORPORATION, Kobe (JP)

(72) Inventors: Masanori Sakamoto, Kobe (JP); Yutaro Iwasa, Kobe (JP); Genki Hatano, Kobe (JP); Koji Shimomura, Kobe (JP)

(73) Assignee: ASICS CORPORATION, Kobe (JP)

( * ) Notice: Subject to any disclaimer, the term of this patent is extended or adjusted under 35 U.S.C. 154(b) by 47 days.

(21) Appl. No.: 17/560,042

(22) Filed: Dec. 22, 2021

(65) Prior Publication Data

US 2022/0202135 A1 Jun. 30, 2022

(30) Foreign Application Priority Data

Dec. 24, 2020 (JP) ..... 2020-215682

(51) Int. Cl.
*A43B 13/18* (2006.01)
*A43B 13/22* (2006.01)

(52) U.S. Cl.
CPC ..... *A43B 13/186* (2013.01); *A43B 13/223* (2013.01)

(58) Field of Classification Search
CPC ..... A43B 13/181; A43B 21/26; A43B 21/32; A43B 3/0036; A43B 13/12; A43B 13/186; A43B 7/06
See application file for complete search history.

(56) References Cited

U.S. PATENT DOCUMENTS 7,730,635 B2 * 6/2010 Aveni ..... A43B 21/26 36/35 R
2012/0266494 A1 * 10/2012 Ko ..... A43B 7/087 36/30 R
2015/0033581 A1 * 2/2015 Barnes ..... A43B 13/125 36/83

(Continued)

FOREIGN PATENT DOCUMENTS

JP 3034179 U 2/1997
JP H10-248604 A 9/1998

(Continued)

OTHER PUBLICATIONS

An Office Action; "Notice of Reasons for Refusal," mailed by the Japanese Patent Office on May 21, 2024, which corresponds to Japanese Patent Application No. 2020-215682 and is related to U.S. Appl. No. 17/560,042; with English language translation.

*Primary Examiner* — Alissa L Hoey
*Assistant Examiner* — Akwokwo Olabisi Redhead
(74) *Attorney, Agent, or Firm* — Studebaker & Brackett PC

(57) ABSTRACT

A shoe sole at least partially comprises a shock absorber, and the shock absorber that includes a shock absorbing portion and a cover portion that has a tread on a side opposite to the shock absorbing portion. The shock absorbing portion is provided with a plurality of pass-through portions passing through the shock absorbing portion as viewed in a direction of a normal to the tread, and the cover portion covers at least one of the plurality of pass-through portions. The cover portion is provided with a communication path having one end open to the pass-through portion and the other end open at the tread, and a condition of R<L is satisfied, where R represents a diameter of a largest virtual incircle of a contour line of an opening of the communication path located closer (Continued)

to the tread, and L represents a length of the communication path.

17 Claims, 29 Drawing Sheets

(56) References Cited

U.S. PATENT DOCUMENTS

| | | | | |
|---|---|---|---|---|
| 2015/0135550 | A1* | 5/2015 | Gishifu | A43B 13/189 36/29 |
| 2017/0150783 | A1* | 6/2017 | Polegato Moretti | A43B 13/386 |
| 2017/0188660 | A1* | 7/2017 | Polegato Moretti | A43B 13/141 |
| 2018/0049514 | A1 | 2/2018 | Guyan et al. | |
| 2018/0271211 | A1 | 9/2018 | Perrault et al. | |
| 2018/0271213 | A1 | 9/2018 | Perrault et al. | |
| 2019/0231018 | A1* | 8/2019 | Boutin | A42B 3/124 |
| 2020/0093221 | A1* | 3/2020 | Caldwell | A43B 21/26 |
| 2022/0202135 | A1* | 6/2022 | Sakamoto | A43B 13/223 |

FOREIGN PATENT DOCUMENTS

| | | | |
|---|---|---|---|
| JP | 2012-029768 | A | 2/2012 |
| JP | 2017-527637 | A | 9/2017 |
| JP | 2018-187363 | A | 11/2018 |
| WO | 2015200201 | A1 | 12/2015 |
| WO | 2020/061384 | A1 | 3/2020 |

* cited by examiner

SHOE SOLE AND SHOE

This nonprovisional application is based on Japanese Patent Application No. 2020-215682 filed on Dec. 24, 2020 with the Japan Patent Office, the entire contents of which are hereby incorporated by reference.

BACKGROUND OF THE INVENTION

Field of the Invention

The present invention relates to a shoe sole comprising a shock absorber for absorbing shock, and a shoe comprising the shoe sole.

Description of the Background Art

Conventionally, various types of shock absorbers for absorbing shock have been known, and these various types of shock absorbers have been used depending on the application. For example, a shoe may have a shoe sole provided with a shock absorber in order to absorb shock caused upon landing. The shock absorber provided to the shoe sole is typically composed of a member made of resin or rubber.

In recent years, there have also been developed shoes having a shoe sole provided with a part having a lattice structure, a web structure or the like so that not only a material but also a structure provides an enhanced shock absorbing function. A shoe comprising a shoe sole provided with a part having a lattice structure is disclosed for example in U.S. Patent Publication No. 2018/0049514.

Japanese National Patent Publication No. 2017-527637 describes that a three-dimensional object which is manufactured in a three-dimensional additive manufacturing method can be manufactured by adding thickness to a geometrical surface structure, such as an internally hollowed polyhedron or a triply periodic minimal surface, and discloses that composing the three-dimensional object of an elastic material allows the object to be applied for example to a shoe sole.

SUMMARY OF THE INVENTION

When it is assumed that, in order to reduce an amount of an adhesive used, a shock absorber is not covered with an outsole and configures the entirety or a portion a tread of a shoe sole, and a portion of the shock absorber that defines the tread has an exposed surface with a hole, a recess or the like, there is a concern that a small stone or a similar foreign matter may enter the hole, recess or the like. When such a foreign matter enters the shock absorber, the foreign matter moves deep inside the shock absorber and may impair its shock absorbing function or damage the shock absorber per se.

While this may be prevented by configuring the exposed surface of the portion of the shock absorber that defines the tread to be a flat surface or a smooth curved surface, such a configuration is often inapplicable for reasons for manufacture. For example, when the shock absorber is manufactured in a three-dimensional additive manufacturing method, it is necessary to provide a surface of the shock absorber with a port for ejecting uncured resin, and to do so, the tread would be provided with a hole.

Accordingly, the present invention has been made in order to solve the above-described problem, and an object of the present invention is to provide a shoe sole which is less likely to induce damage to and deterioration in performance of a shock absorber due to intrusion of foreign matters even when the shock absorber forms a tread entirely or partially, and a shoe comprising the shoe sole.

A shoe sole according to a first aspect of the present invention at least partially comprises a shock absorber and is also provided with a tread. The shock absorber includes a shock absorbing portion composed of a three-dimensional structure composed of a unit structure repeatedly, regularly and successively disposed in at least one direction, the unit structure having a three-dimensional shape formed by a wall having an external shape defined by a pair of parallel planes or curved surfaces. The shock absorbing portion is provided with a plurality of pass-through portions passing through the shock absorbing portion as viewed in a direction of a normal to the tread. The shock absorber, as viewed in the direction of the normal to the tread, is provided with a cover portion that corresponds to at least one of the plurality of pass-through portions included in the shock absorbing portion and covers that pass-through portion. The shock absorber is formed of a single member formed with the shock absorbing portion and the cover portion continuously connected together. The tread is defined by a main surface of the cover portion that is located on a side opposite to a side where the shock absorbing portion is located, and the cover portion is provided with a communication path having one end open to the pass-through portion and the other end open at the tread. The sole according to the first aspect of the present invention satisfies a condition of $R<L$, where R represents a diameter of a largest virtual incircle of a contour line of an opening of the communication path located closer to the tread, and L represents a length of the communication path in a direction in which the communication path extends.

A shoe sole according to a second aspect of the present invention at least partially comprises a shock absorber and is also provided with a tread. The shock absorber includes a shock absorbing portion composed of a three-dimensional structure composed of a unit structure repeatedly, regularly and successively disposed in at least one direction, the unit structure having a three-dimensional shape formed by a wall having an external shape defined by a pair of parallel planes or curved surfaces. The shock absorbing portion is provided with a plurality of pass-through portions passing through the shock absorbing portion as viewed in a direction of a normal to the tread. The shock absorber, as viewed in the direction of the normal to the tread, is provided with a cover portion that corresponds to at least one of the plurality of pass-through portions included in the shock absorbing portion and covers that pass-through portion, and a columnar portion that interconnects the shock absorbing portion and the cover portion. The shock absorber is formed of a single member formed with the shock absorbing portion, the columnar portion, and the cover portion continuously connected together. The tread is defined by a main surface of the cover portion that is located on a side opposite to a side where the columnar portion is located. The sole according to the second aspect of the present invention has the pass-through portion in external communication via a gap formed by providing the columnar portion and the cover portion.

A shoe based on the present invention comprises the shoe sole according to the first or second aspect of the present invention described above, and an upper provided above the shoe sole.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, embodiments of the present invention will be described in detail with reference to the accompanying drawings. In the following embodiments, identical or common portions are identically denoted in the figures, and will not be described repeatedly.

First Embodiment

Figure 1:
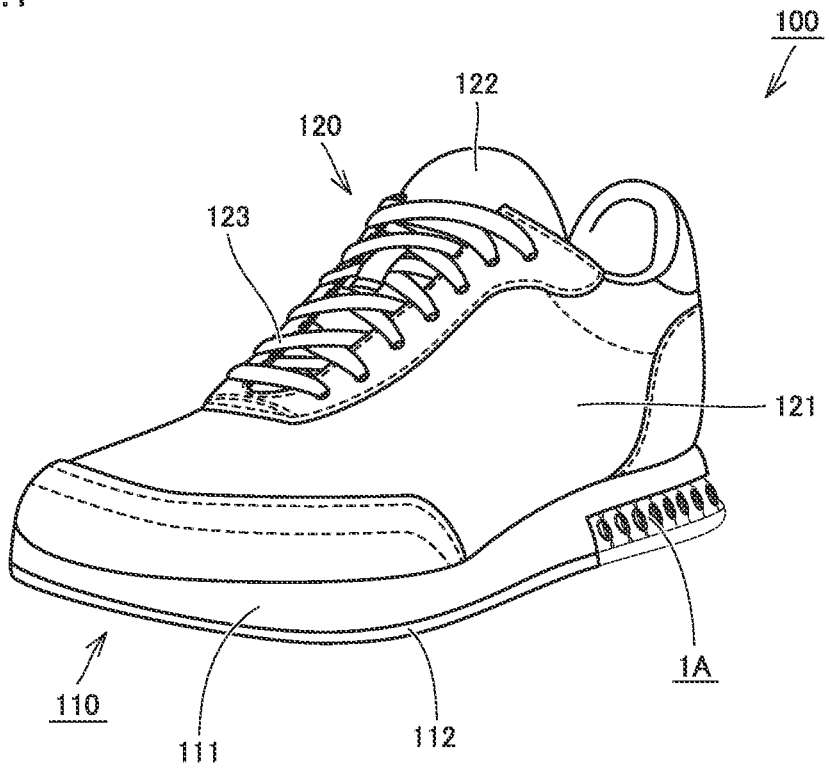
FIG. 1 is a perspective view of a shoe sole and a shoe comprising the shoe sole according to a first embodiment.
Figure 2:
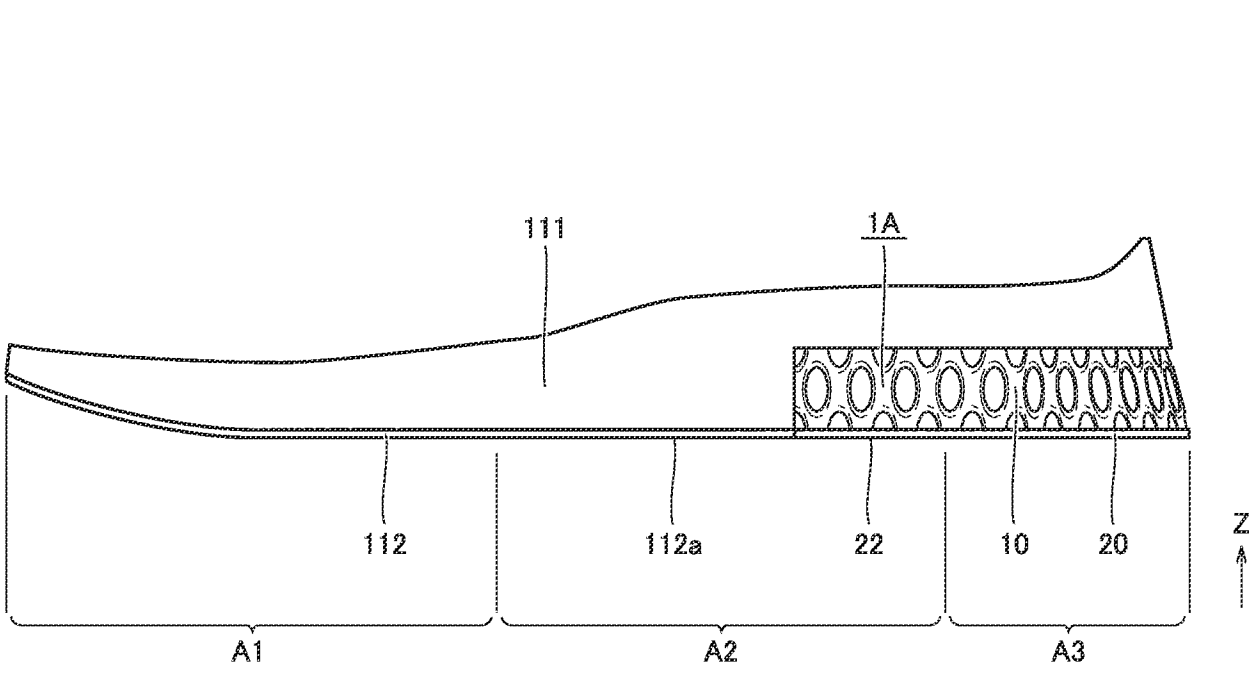
FIG. 2 is a side view of the shoe sole shown in FIG. 1.

FIG. 1 is a perspective view of a shoe sole and a shoe comprising the shoe sole according to a first embodiment, and FIG. 2 is a side view of the shoe sole shown in FIG. 1. Initially, a shoe 100 according to the present embodiment will be described with reference to FIGS. 1 and 2.

As shown in FIG. 1, the shoe 100 comprises a shoe sole 110 and an upper 120. The shoe sole 110 is a member that covers the sole of a foot and has a generally flat shape. The upper 120 has a shape that at least covers the entirety of a portion of a foot inserted in the shoe that is located on the side of the bridge of the foot, and the upper 120 is located above the shoe sole 110.

The upper 120 includes an upper body 121, a tongue 122, and a shoelace 123. Of these, the tongue 122 and the shoelace 123 are both fixed to or attached to the upper body 121.

The upper body 121 has an upper portion provided with an upper opening for exposing an upper portion of an ankle and a portion of the bridge of a foot. The upper body 121 has a lower portion provided with a lower opening covered with the shoe sole 110 as an example and has a lower end French-seamed or the like to form a bottom portion as another example.

The tongue 122 is fixed to the upper body 121 by sewing, welding, bonding, or a combination thereof so as to cover a portion of the upper opening provided in the upper body 121 that exposes a portion of the bridge of a foot. For the upper body 121 and the tongue 122, woven fabric, knitted fabric, nonwoven fabric, synthetic leather, resin, or the like is used for example, and for a shoe required to be air permeable and lightweight, in particular, a double raschel warp knitted fabric with a polyester yarn knitted therein is used.

The shoelace 123 is composed of a member in the form of a string for drawing portions of a peripheral edge of the upper opening provided to the upper body 121 and exposing a portion of the bridge of a foot together in the direction of the width of the foot, and the shoelace 123 is passed through a plurality of hole provided through the peripheral edge of the upper opening. When a foot is inserted in the upper body 121 and the shoelace 123 is tightened, the upper body 121 can be brought into close contact with the foot.

As shown in FIGS. 1 and 2, the shoe sole 110 has a midsole 111, an outsole 112, and a shock absorber 1A. The midsole 111 is located at an upper portion of the shoe sole 110 and joined to the upper 120. The outsole 112 and shock absorber 1A are both located at a lower portion of the shoe sole 110 and joined to the midsole 111.

As shown in FIG. 2, in a fore-aft direction representing a longitudinal direction in a plan view (in the figure, a lateral direction), the shoe sole 110 is divided into a forefoot portion A1 supporting the toes and ball of a foot of a wearer of the shoe, a midfoot portion A2 supporting the arch of the foot of the wearer, and a rearfoot portion A3 supporting the heel of the foot of the wearer. The midsole 111 extends in the fore-aft direction from the forefoot portion A1 via the midfoot portion A2 to reach the rearfoot portion A3. In contrast, the outsole 112 is located at the forefoot portion A1 and a portion of the midfoot portion A2 closer to the front side in the fore-aft direction, and the shock absorber 1A is located at a portion of the midfoot portion A2 closer to the rear side in the fore-aft direction and the rearfoot portion A3.

Thus, the outsole 112 and the shock absorber 1A are positioned adjacent to each other in the fore-aft direction, and the shoe sole 110 has a tread composed of the outsole 112 and the shock absorber 1A. That is, the outsole 112 has a lower end with a tread 112*a*, and the tread 112*a* defines a tread of the shoe sole 110 extending from the forefoot portion A1 to reach a generally center portion of the midfoot portion A2. In contrast, the shock absorber 1A has a lower end with a tread 22, and the tread 22 defines a tread of the shoe sole 110 extending from the generally center portion of the midfoot portion A2 to reach the rearfoot portion A3.

The midsole 111 preferably has an appropriate strength and also excellently absorbs shock, and from this viewpoint, the midsole 111 can be a member for example of resin or rubber, and suitably composed of a foam material or a non-foam material such polyolefin resin, an ethylene-vinyl acetate copolymer (EVA), polyamide-based thermoplastic elastomer (TPA, TPAE), thermoplastic polyurethane (TPU), polyester-based thermoplastic elastomer (TPEE), and the like, in particular.

The outsole 112 preferably provides excellent abrasion resistance and excellent grip, and from this viewpoint, the outsole 112 can be made of rubber, for example. A tread pattern may be provided on a lower surface of the outsole 112, or the tread 112*a*, from the viewpoint of providing enhanced grip.

While the shock absorber 1A is not particularly limited to any particular material, it can be formed for example of a resin material or a rubber material, and particularly suitably composed of polyolefin resin, an ethylene-vinyl acetate copolymer (EVA), a polyamide-based thermoplastic elastomer (TPA, TPAE), thermoplastic polyurethane (TPU), a polyester-based thermoplastic elastomer (TPEE), butadiene rubber, and the like. It can also be a polymer composition such as an olefin-based polymer, an amide-based polymer, an ester-based polymer, a urethane-based polymer, a styrene-based polymer, an acrylic polymer or the like.

Herein, the shoe 100 according to the present embodiment has the midsole 111 with a notch having a prescribed shape, and the shock absorber 1A is accommodated in the notch and thus incorporated in the shoe sole 110. The shock absorber 1A can be bonded to the midsole 111 by adhesion or the like. The outsole 112 is assembled so as to partially or entirely cover a portion of the lower surface of the midsole 111 other than the portion provided with the notch. The outsole 112 can be bonded to the midsole 111 for example by adhesion or the like.

Figure 3:
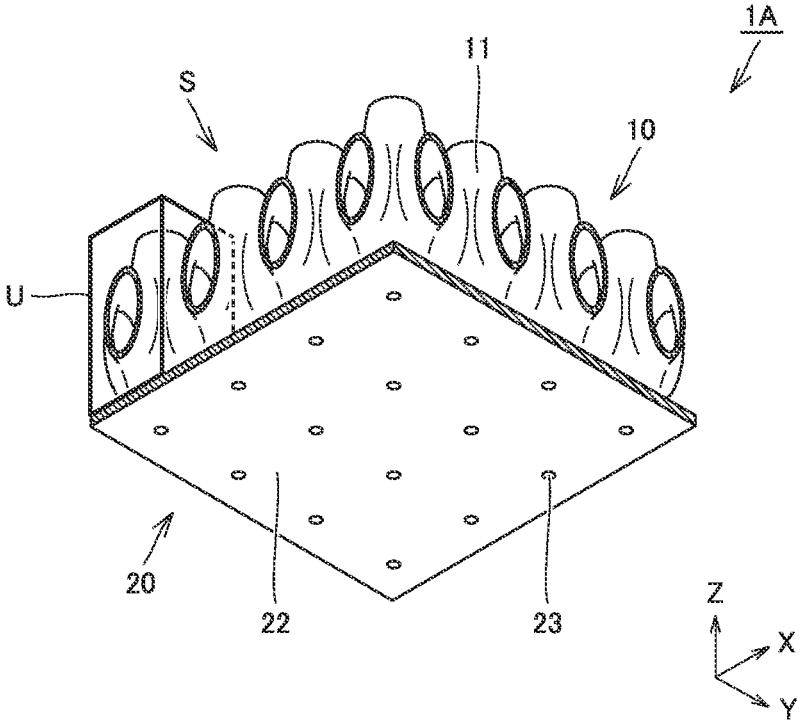
FIG. 3 is a perspective view of a shock absorber that the shoe sole according to the first embodiment comprises.
Figure 4B:
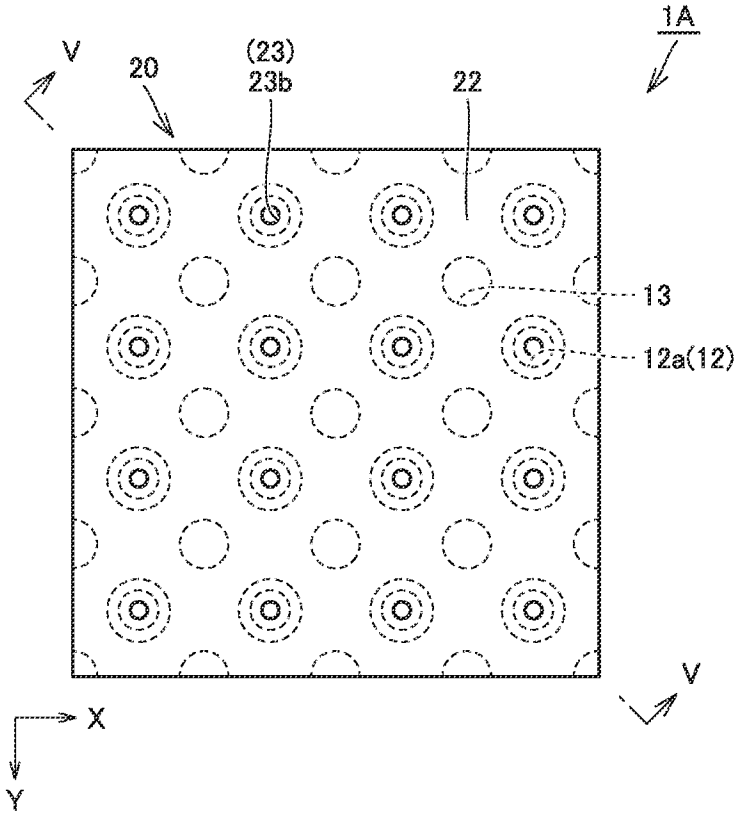
FIG. 4B is a general bottom view of the shock absorber shown in FIG. 3.
Figure 4A:
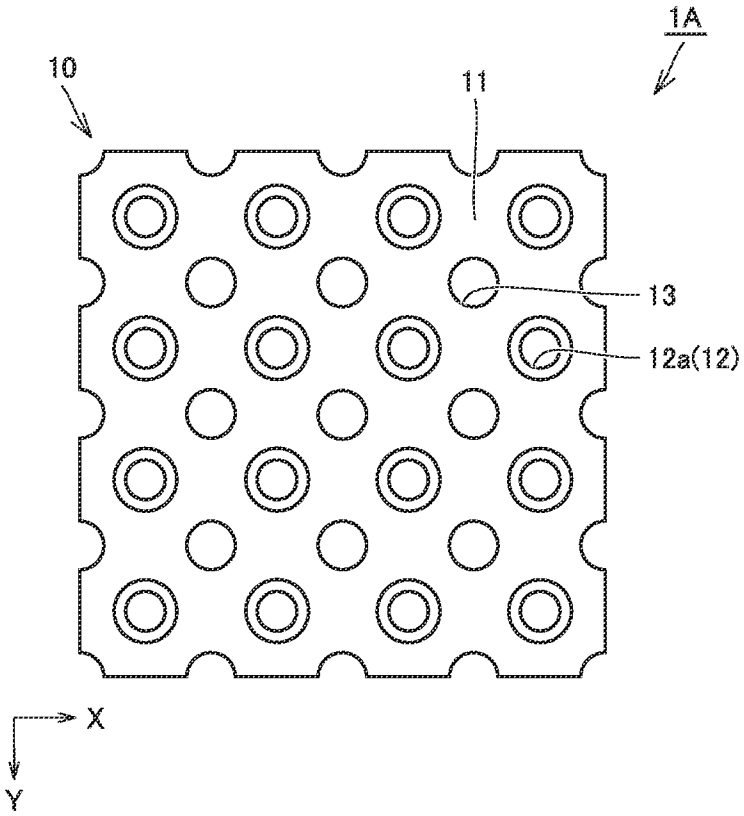
FIG. 4A is a bottom view of the shock absorber shown in FIG. 3 with a cover portion removed.
Figure 5:
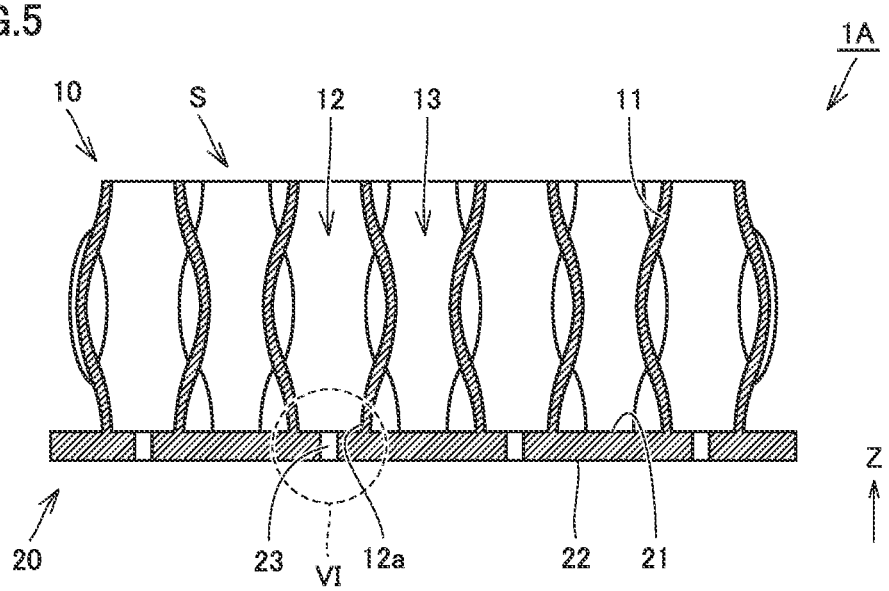
FIG. 5 is a cross section of the shock absorber shown in FIG. 3.

FIG. 3 is a perspective view of the shock absorber shown in FIG. 1. FIGS. 4A and 4B are bottom views of a shock absorbing portion of the shock absorber shown in FIG. 3, and FIG. 4A is a bottom view of the shock absorber with a cover portion removed (that is, a bottom view of the shock absorbing portion) and FIG. 4B is a general bottom view of the shock absorber including the shock absorbing portion and the cover portion. FIG. 5 is a cross section taken along a line V-V shown in FIG. 4B. Hereinafter, reference will be made to FIGS. 3 to 5 to describe a schematic configuration of the shock absorber 1A according to the present embodiment.

As shown in FIGS. 3 to 5, the shock absorber 1A has a shock absorbing portion 10 and a cover portion 20. The shock absorbing portion 10 includes a three-dimensional structure S having a plurality of unit structures U (see FIG. 3, in particular). The plurality of unit structures U each have a three-dimensional shape formed by a wall 11 having an external shape defined by a pair of parallel, geometrical curved surfaces. The cover portion 20 is generally in the form of a flat plate and configures the tread 22 described above. The shock absorber 1A is a single member formed of the shock absorbing portion 10 and the cover portion 20 continuously connected together.

Herein, while the shock absorber 1A may be manufactured in any method, it can be additively manufactured using a three dimensional additive manufacturing apparatus for example. When the shock absorber 1A is additively manufactured using the three dimensional additive manufacturing apparatus, the shock absorbing portion 10 and the cover portion 20 will be identical in material. Note, however, that when a three dimensional additive manufacturing apparatus of a fused deposition modelling (FDM) system is used, it is also possible to form the shock absorbing portion 10 of a material and form the cover portion 20 of a different material.

While the shock absorber 1A (that is, the shock absorbing portion 10 and the cover portion 20) may basically be formed of any material having a large elastic force, it is preferably formed of a resin material or a rubber material, as has been discussed above. More specifically, when the shock absorber 1A is formed of resin, the shock absorber 1A can be formed for example of polyolefin resin, an ethylene-vinyl acetate copolymer (EVA), a polyamide-based thermoplastic elastomer (TPA, TPAE), thermoplastic polyurethane (TPU), a polyester-based thermoplastic elastomer (TPEE), or the like. When the shock absorber 1A is formed of rubber, it can be formed for example of butadiene rubber.

The shock absorber 1A may be composed of a polymer composition. In that case, examples of a polymer to be contained in the polymer composition include olefinic polymers such as olefinic elastomers and olefinic resins. The olefinic polymers for example include polyolefins of polyethylene (e.g., linear low density polyethylene (LLDPE), high density polyethylene (HDPE), and the like), polypropylene, an ethylene-propylene copolymer, a propylene-1-hexene copolymer, a propylene-4-methyl-1-pentene copolymer, a propylene-1-butene copolymer, an ethylene-1-hexene copolymer, an ethylene-4-methyl-pentene copolymer, an ethylene-1-butene copolymer, a 1-butene-1-hexene copolymer, 1-butene-4-methyl-pentene, an ethylene-methacrylic acid copolymer, an ethylene-methyl methacrylate copolymer, an ethylene-ethyl methacrylate copolymer, an ethylene-butyl methacrylate copolymer, an ethylene-methyl acrylate copolymer, an ethylene-ethyl acrylate copolymer, an ethylene-butyl acrylate copolymer, a propylene-methacrylic acid copolymer, a propylene-methyl methacrylate copolymer, a propylene-ethyl methacrylate copolymer, a propylene-butyl methacrylate copolymer, a propylene-methyl acrylate copolymer, a propylene-ethyl acrylate copolymer, a propylene-butyl acrylate copolymer, an ethylene-vinyl acetate copolymer (EVA), a propylene-vinyl acetate copolymer, and the like.

The polymer may be an amide-based polymer such as an amide-based elastomer and an amide-based resin. Examples of the amide-based polymer include polyamide 6, polyamide 11, polyamide 12, polyamide 66, and polyamide 610.

The polymer may be an ester-based polymer such as an ester-based elastomer and an ester-based resin. Examples of the ester-based polymer include polyethylene terephthalate and polybutylene terephthalate.

The polymer may be a urethane-based polymer such as a urethane-based elastomer and a urethane-based resin. Examples of the urethane-based polymer include polyester-based polyurethane and polyether-based polyurethane.

The polymer may be a styrene-based polymer such as a styrene-based elastomer and a styrene-based resin. Examples of the styrene-based elastomer include styrene-ethylene-butylene copolymer (SEB), styrene-butadiene-styrene copolymer (SBS), a hydrogenated product of SBS (styrene-ethylene-butylene-styrene copolymer (SEBS)), styrene-isoprene-styrene copolymer (SIS), a hydrogenated product of SIS (styrene-ethylene-propylene-styrene copolymer (SEPS)), styrene-isobutylene-styrene copolymer (SIBS), styrene-butadiene-styrene-butadiene (SBSB), styrene-butadiene-styrene-butadiene-styrene (SBSBS), and the like. Examples of the styrene-based resin include polystyrene, acrylonitrile styrene resin (AS), and acrylonitrile butadiene styrene resin (ABS).

Examples of the polymer include acrylic polymers such as polymethylmethacrylate, urethane-based acrylic polymers, polyester-based acrylic polymers, polyether-based acrylic polymers, polycarbonate-based acrylic polymers, epoxy-based acrylic polymers, conjugated diene polymer-based acrylic polymers and hydrogenated products thereof, urethane-based methacrylic polymers, polyester-based methacrylic polymers, polyether-based methacrylic polymers, polycarbonate-based methacrylic polymers, epoxy-based methacrylic polymers, conjugated diene polymer-based methacrylic polymers and hydrogenated products thereof, polyvinyl chloride-based resins, silicone-based elastomers, butadiene rubber (BR), isoprene rubber (IR), chloroprene rubber (CR), natural rubber (NR), styrene-butadiene rubber (SBR), acrylonitrile-butadiene rubber (NBR), butyl rubber (IIR), and the like.

As shown in FIGS. 3 and 5, the shock absorbing portion 10 and the cover portion 20 are stacked in layers in the direction of a normal to the tread 22 provided on the cover portion 20. Thus, the shock absorbing portion 10 has a bottom surface covered with the cover portion 20, and the shock absorbing portion 10 is located over the cover portion 20.

Note that FIGS. 3 to 5 show a portion of the shock absorber 1A shown in FIG. 1 cut out, and in FIG. 3, the cut-away surface is hatched. Furthermore, in FIG. 3, in order to facilitate understanding, reference character U does not denote the above-described unit structure in a strict sense; rather, it denotes a cuboidal unit space occupied by the unit structure.

The plurality of unit structures U are repeatedly, regularly and successively disposed in each of widthwise, depthwise and heightwise directions. As shown in FIG. 3, the shock absorber 1A of the cut-out portion has four unit structures U aligned in each of the widthwise direction or an X direction and the depthwise direction or a Y direction, and has one unit structure U disposed in the heightwise direction or a Z direction. How many unit structures U are repeated in the widthwise, depthwise and heightwise directions is not particularly limited, and two or more unit structures disposed in at least one of the three directions suffice.

The shock absorber 1A according to the present embodiment is intended to exhibit a shock absorbing function in the heightwise direction (the Z direction shown in the figure). Accordingly, when the shock absorber 1A receives a load, the shock absorber 1A will exhibit the shock absorbing function in a direction that matches the heightwise direction described above. The heightwise direction is the same as the direction of the normal to the tread 22 of the cover portion 20.

As has been described above, the plurality of unit structures U each have a three-dimensional shape formed by wall 11. Therefore, as the plurality of unit structures U are successively interconnected, the three-dimensional structure S is also composed of a set of walls 11.

Herein, the three-dimensional structure S included in the shock absorber 1A has a structure which is a geometrical surface structure with thickness added thereto. In the shock absorber 1A according to the present embodiment, the surface structure is a Schwarz' P structure, which is a type of mathematically defined triply periodic minimal surface. Note that a minimal surface is defined as a curved surface of those having a given closed curve as a boundary that is minimal in area.

As shown in FIG. 5, the three-dimensional structure S that is a Schwarz' P structure with a thickness added thereto presents a cross-sectional shape with the wall 11 extending in a meandering manner when the three-dimensional structure S is cut along a specific plane. The specific plane is for example a plane orthogonal to the plane of the sheet of FIG. 4B and parallel to the line V-V. As it has the wall 11 having a cross-sectional shape extending in a meandering manner, the shock absorbing portion 10 of the shock absorber 1A has a plurality of pass-through portions. The pass-through portion as referred to herein is a portion passing through the shock absorbing portion 10 without being interrupted by the wall 11 when the shock absorbing portion 10 is viewed in a predetermined direction.

While for the plurality of pass-through portions there will be six types of pass-through portions in total in view of the structure of the three-dimensional structure S: two types extending in the widthwise direction; two types extending in the depthwise direction; and two types extending in the heightwise direction, herein, a first pass-through portion 12 and a second pass-through portion 13 which appear in the cross section shown in FIG. 5, that is, extend in the heightwise direction (i.e., the Z direction), are noted.

As shown in FIGS. 4A and 5, the first pass-through portion 12 is located inside the generally cylindrical unit structure U shown in FIG. 3, and passes through the shock absorbing portion 10 in the heightwise direction along the central axis of the generally cylindrical unit structure U. In contrast, the second pass-through portion 13 is located outside the generally cylindrical unit structure U shown in FIG. 3, and passes through the shock absorbing portion 10 in the heightwise direction between the unit structure U and another adjacent unit structure.

That is, while the first pass-through portion 12 and the second pass-through portion 13 have a common feature in that they pass through the shock absorbing portion 10 when viewed in the direction of the normal to the tread 22, they are distinguished in where they are formed and in what shape the wall 11 that defines them is formed.

Herein, as shown in FIG. 4A, the bottom surface of the shock absorbing portion 10 has a plurality of first open ends 12*a* in a matrix, each first open end 12*a* being in the form of a circle in plan view separated from one another and in communication with a corresponding one of the plurality of first pass-through portions 12 in the direction of the normal to the tread 22. Furthermore, the bottom surface of the shock absorbing portion 10 has a second open end disposed generally in the form of a lattice in plan view to surround the plurality of first open ends 12*a* and in communication with the plurality of second pass-through portions 13 in the direction of the normal to the tread 22.

As shown in FIGS. 3, 4B and 5, the cover portion 20 covers the bottom surface of the shock absorbing portion 10, and has a connected surface 21 (see FIG. 5 in particular) connected to the shock absorbing portion 10, and the above-described tread 22 located on a side opposite to the connected surface 21. The cover portion 20 is provided with a plurality of communication paths 23 in the form of through holes disposed in a matrix. When the shock absorber 1A is manufactured in the above-described three-dimensional additive manufacturing method, the communication paths 23 are necessarily introduced for a reason to be addressed in manufacturing the shock absorber, and more specifically, the communication paths 23 serve as ports for ejecting uncured resin.

As shown in FIGS. 4B and 5, the plurality of communication paths 23 are arranged to correspond to the plurality of first open ends 12*a* provided in the bottom surface of the shock absorbing portion 10. The communication paths 23 each have one end open to the corresponding first pass-through portion 12 and the other end open at the tread 22. Thus, the plurality of communication paths 23 allow the shock absorbing portion 10 to have an internal space in communication with outside to eject uncured resin in manufacturing the shock absorber.

When there is no consideration made for the fact that the plurality of communication paths 23 are exposed at the tread 22, however, there is a possibility that a foreign matter such as a small stone may enter the communication paths 23 and can cause a problem such as impairing the shock absorbing function of the shock absorber, damaging the shock absorber per se, and the like. That is, while the second open end has its area entirely covered with the cover portion 20, the first open end 12*a* described above is not completely covered with the cover portion 20, and accordingly, it is necessary to address the above problem.

Figure 6:
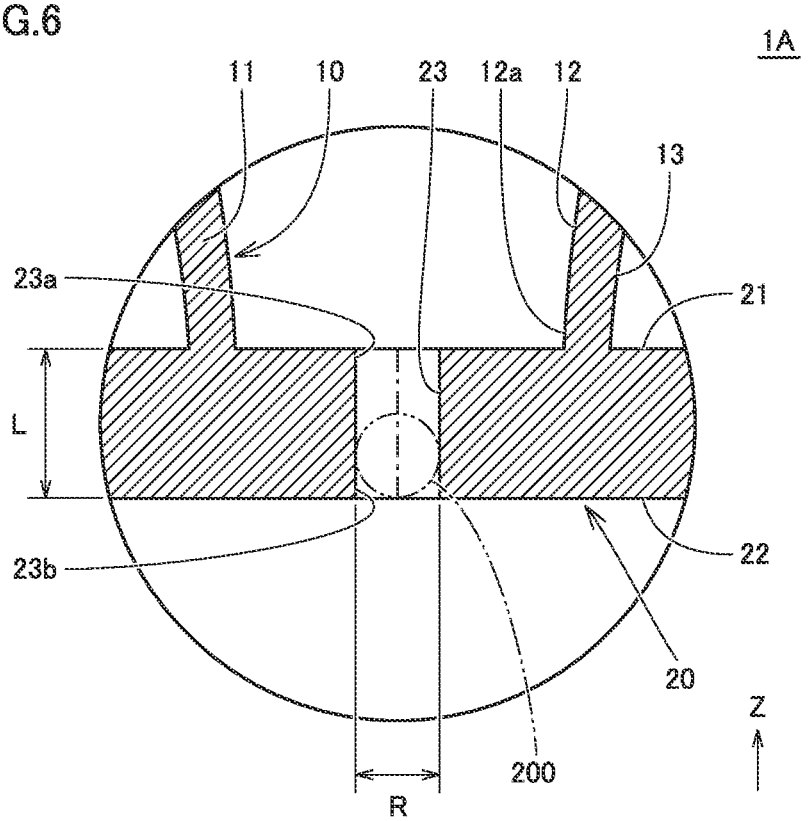
FIG. 6 is an enlarged cross section of a main portion of the shock absorber shown in FIG. 3.

In this regard, the shock absorber 1A according to the present embodiment addresses this issue by devising the plurality of communication paths 23 in shape. Hereinafter, this point will be described with reference to FIGS. 6 and 3 to 5. FIG. 6 is an enlarged cross section of a region VI shown in FIG. 5.

As shown in FIGS. 3 to 6, the shock absorber 1A according to the present embodiment is such that the plurality of communication paths 23 are each in the form of a columnar through hole extending in the direction of the normal to the tread 22, and each have a size smaller than that of the corresponding first open end 12*a*. That is, the communication path 23 has an opening 23*a* on the side of the shock absorbing portion and an opening 23*b* on the side of the tread (see FIG. 6 for both) and the opening 23*a* on the side of the shock absorbing portion is smaller in size than the first open end 12*a*. Thus, the plurality of first open ends 12*a* each have its area partially covered with the cover portion 20.

Therefore, even a foreign matter smaller in size than the first open end 12*a* can be effectively prevented from entering insofar as the foreign matter is larger in size than the communication path 23. In this respect, the communication path 23 is preferably 0.8 mm or more and 4.5 mm or less, more preferably 1.4 mm or more and 4.0 mm or less in diameter from the viewpoint of reliably ejecting uncured resin in manufacturing the shock absorber and the viewpoint of the fact that a sufficiently fine foreign matter is unlikely to lead to deterioration in performance or to damage as described above if it should enter the shock absorber 1A.

However, even such a configuration cannot prevent intrusion of a foreign matter smaller than the diameter of the communication path 23, and in some cases, the foreign matter may lead to deterioration in performance or to damage.

In this regard, as shown in FIG. 6, the shock absorber 1A according to the present embodiment is configured to satisfy a condition of $R<L$ where R represents a diameter of the opening 23*b* of the communication path 23 closer to the tread and L represents a length of the communication path 23 in a direction in which the communication path 23 extends (Note that in FIG. 6, the length L corresponds to an axial length of the communication path 23 indicated by a dashed line).

With this structure, considering that a fine sand grain assumed as a foreign matter 200 is basically substantially spherical, even when the foreign matter 200 enters the communication path 23, the foreign matter 200 will stay in the vicinity of the opening 23*b* of the communication path 23 closer to the tread, and the foreign matter 200 can be prevented from immediately moving toward the opening 23*a* on the side of the shock absorbing portion and thus reaching inside the shock absorbing portion 10.

The shoe sole 110 comprising the shock absorber 1A thus configured and the shoe 100 comprising the shoe sole 110 can prevent the foreign matter 200 entering the same from inviting damage to the shock absorber 1A or deterioration thereof in performance.

Note that the diameter R of the opening 23*b* on the side of the tread and the length L of the communication path 23 described above preferably satisfy a condition of $1.0<L/R<10.0$, more preferably a condition of $1.1<L/R<2.5$. This is because, although depending on the material of the cover portion 20, when L/R exceeds 10.0, the shock absorber 1A increases in weight, and the shoe 100 would be heavy.

(First to Seventh Variations) FIGS. 7 to 13 are enlarged cross sections showing main portions of shock absorbers according to first to seventh variations, respectively. Hereinafter, shock absorbers 1A1 to 1A7 according to the first to seventh variations based on the first embodiment described above will be described with reference to FIGS. 7 to 10.

While in the first embodiment described above the communication path 23 provided in the cover portion 20 is in the form of a columnar through hole extending in the direction of the normal to the tread 22 by way of example, the communication path 23 is variable in shape. The first to seventh variations described below exemplify a case in which the shock absorber 1A is thus modified. As well as in first embodiment, the shock absorbers 1A1 to 1A7 according to the first to seventh variations are also configured such that the diameter R of the opening 23*b* on the side of the tread and the length L of the communication path 23 satisfy the condition of R<L.

Figure 7:
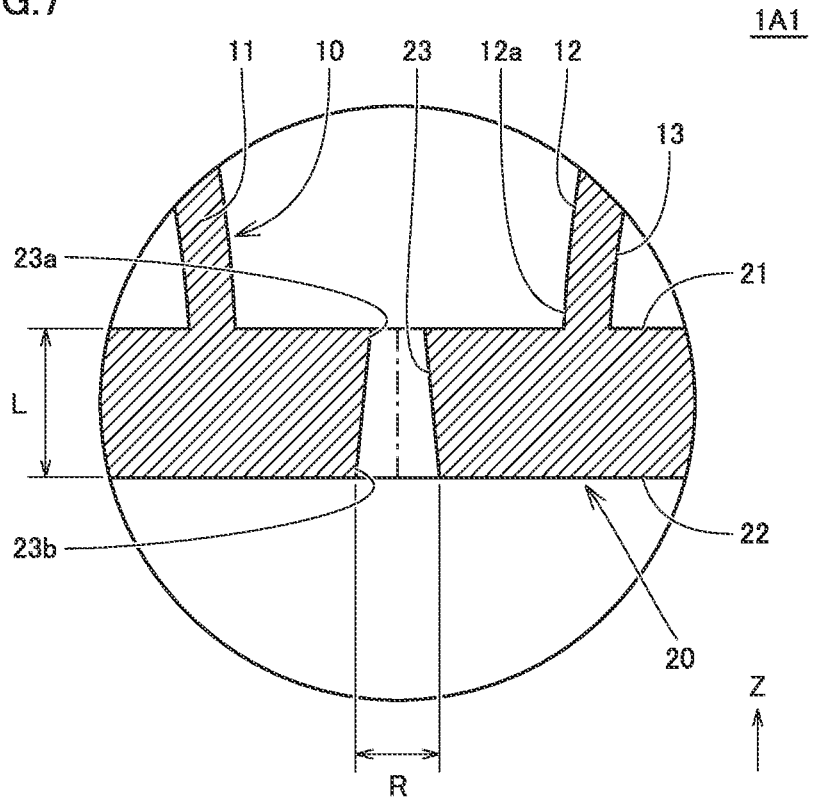
FIG. 7 is an enlarged cross section of a main portion of a shock absorber according to a first variation.

As shown in FIG. 7, the shock absorber 1A1 according to the first variation is formed with the communication path 23 having a shape in cross section gradually reduced in diameter to have an area in cross section decreasing from the side of the tread 22 toward the side of the connected surface 21 (that is, the side of the first pass-through portion 12). In such a configuration, the communication path 23 has an opening 23*a* on the side of the shock absorbing portion smaller in size than the opening 23*b* on the side of the tread. The configuration can thus effectively prevent a foreign matter having entered the communication path 23 from moving toward the opening 23*a* on the side of the shock absorbing portion.

Figure 8:
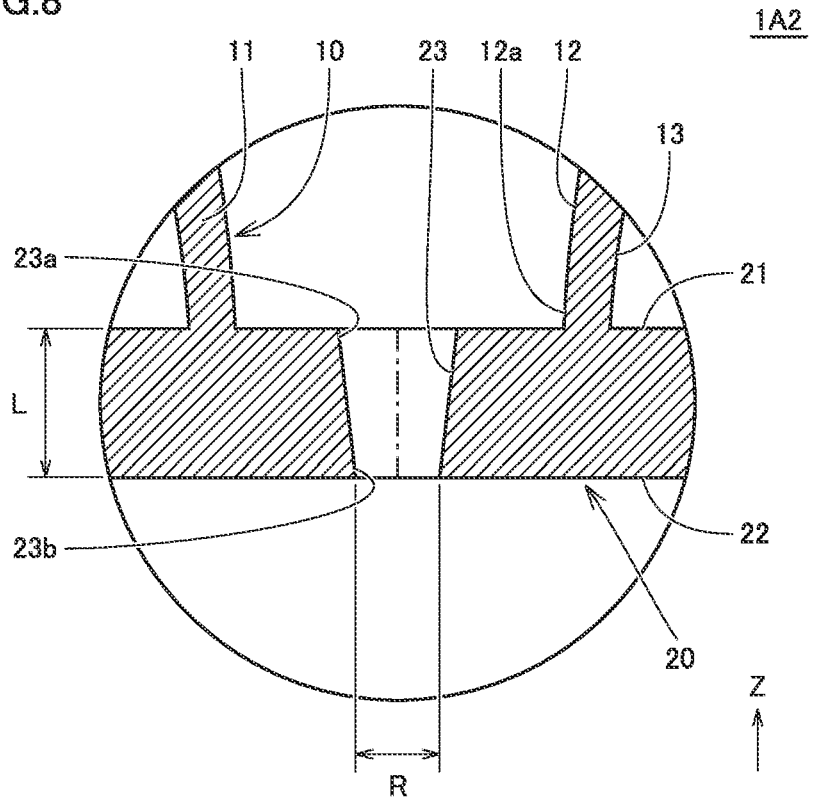
FIG. 8 is an enlarged cross section of a main portion of a shock absorber according to a second variation.

As shown in FIG. 8, the shock absorber 1A2 according to the second variation is formed with the communication path 23 having a shape in cross section gradually reduced in diameter to have an area in cross section decreasing from the side of the connected surface 21 (that is, the side of the first pass-through portion 12) toward the side of the tread 22. In such a configuration, the communication path 23 has an opening 23*b* on the side of the tread smaller in size than the opening 23*a* on the side of the shock absorbing portion. This configuration can more effectively suppress intrusion of a foreign matter into the communication path 23.

Figure 9:
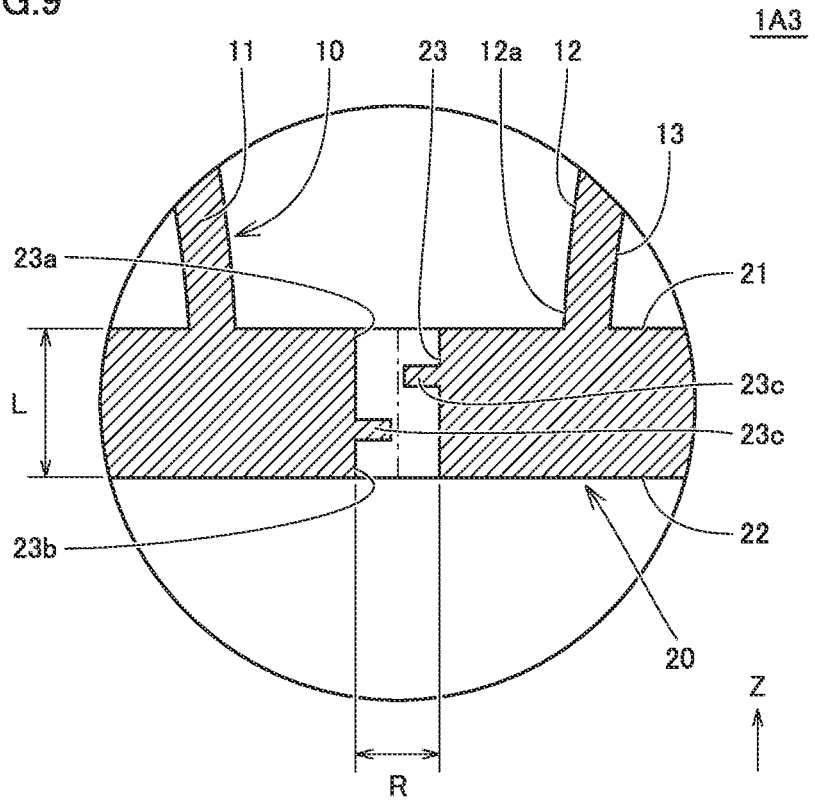
FIG. 9 is an enlarged cross section of a main portion of a shock absorber according to a third variation.

As shown in FIG. 9, the shock absorber 1A3 according to the third variation has the communication path 23 defined by a wall surface provided with a plurality of projections 23*c* projecting inward. In such a configuration, the projection 23*c* functions as a stopper to prevent a foreign matter having entered the communication path 23 from moving toward the opening 23*a* on the side of the shock absorbing portion, and can thus effectively prevent the foreign matter from reaching inside the shock absorbing portion 10.

Figure 10:
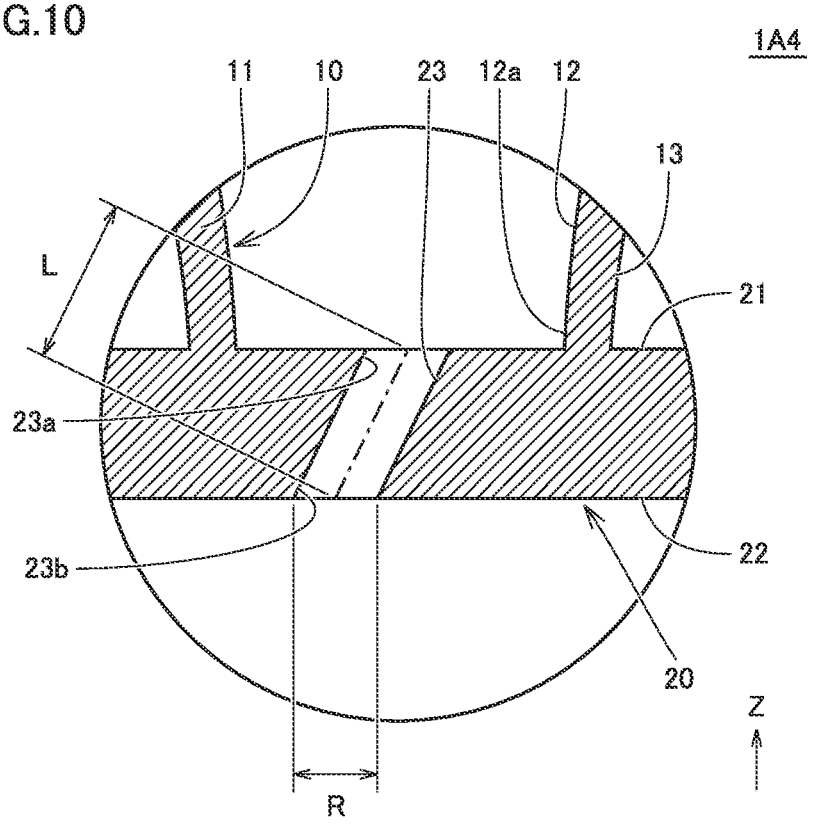
FIG. 10 is an enlarged cross section of a main portion of a shock absorber according to a fourth variation.

As shown in FIG. 10, the shock absorber 1A4 according to the fourth variation has the communication path 23 inclined to extend in a direction intersecting the direction of the normal to the tread 22. This configuration allows the communication path 23 to have a length L increased without increasing the cover portion 20 in thickness. This configuration can prevent deterioration in performance of and damage to the shock absorber without increasing the shock absorber in weight.

Figure 11:
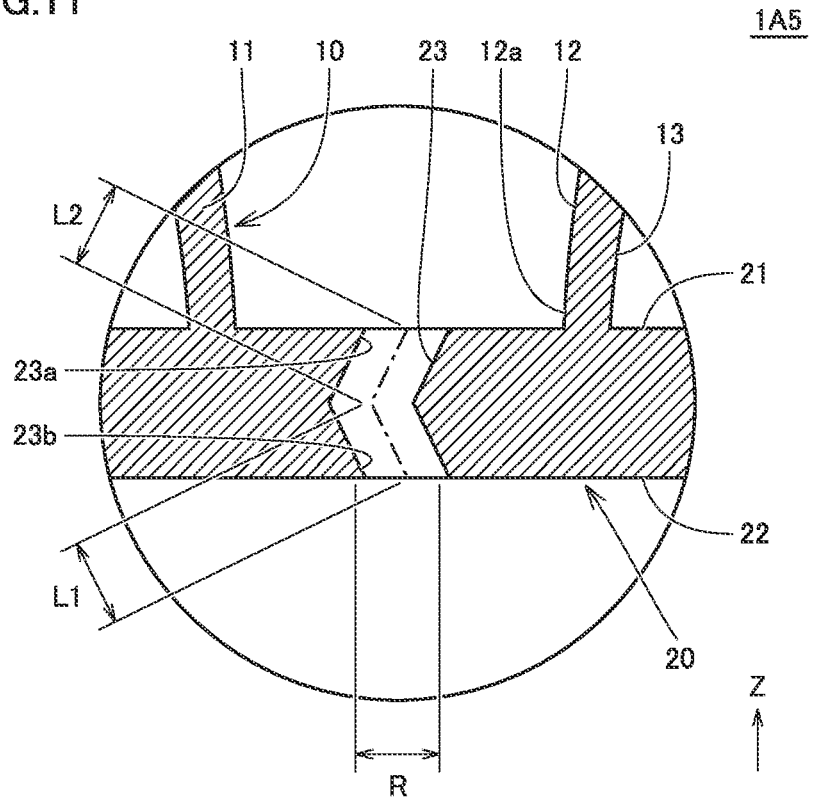
FIG. 11 is an enlarged cross section of a main portion of a shock absorber according to a fifth variation.

As shown in FIG. 11, the shock absorber 1A5 according to the fifth variation has the communication path 23 inclined, and furthermore, bent, to extend in a direction intersecting the direction of the normal to the tread 22. This configuration, as well as the fourth variation described above, allows the communication path 23 to have a length L increased without increasing the cover portion 20 in thickness. This configuration can prevent deterioration in performance of and damage to the shock absorber without increasing the shock absorber in weight.

Herein, when the communication path 23 is bent as in the shock absorber 1A5 according to the fifth variation, the length of the locus connecting center portions of the communication path 23 in cross sections orthogonal to the direction in which the communication path 23 extends will be the length L of the communication path 23 as described above. That is, a sum of lengths L1 and L2 shown in FIG. 11 will be the length L of the communication path 23.

Figure 12:
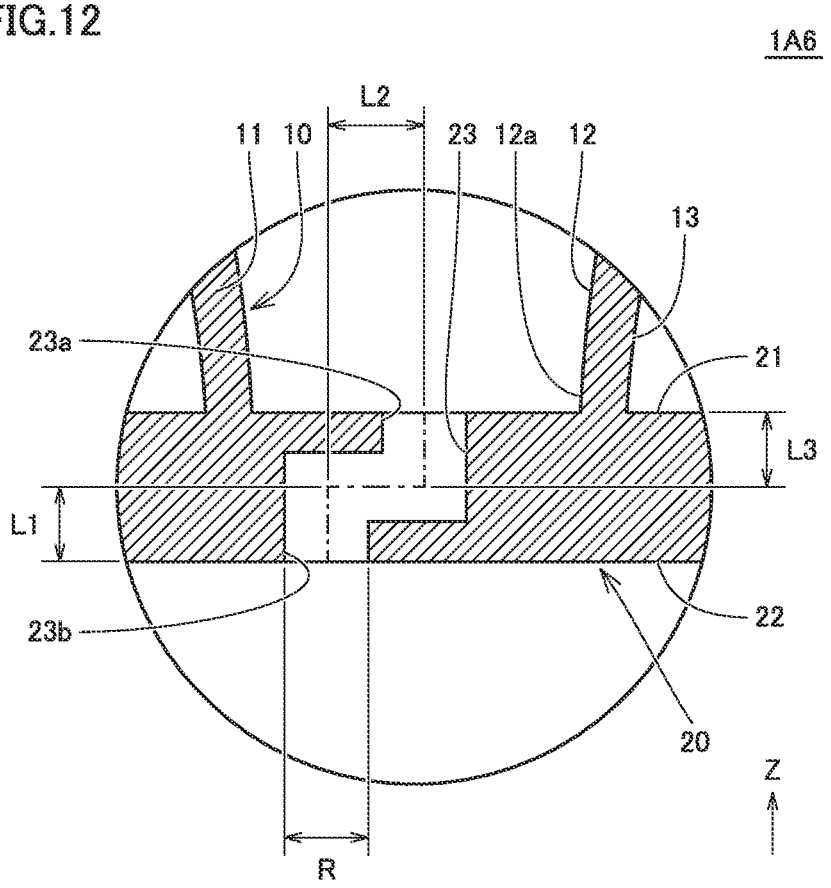
FIG. 12 is an enlarged cross section of a main portion of a shock absorber according to a sixth variation.

As shown in FIG. 12, the shock absorber 1A6 according to the sixth variation has the communication path 23 bent a plurality of times in a cranked manner to include a portion extending in a direction intersecting the direction of the normal to the tread 22. This configuration, as well as the fourth variation described above, allows the communication path 23 to have a length L increased without increasing the cover portion 20 in thickness. This configuration can prevent deterioration in performance of and damage to the shock absorber without increasing the shock absorber in weight.

Herein, the communication path 23 bent a plurality of times as in the shock absorber 1A6 according to the sixth variation is also such that the length of the locus connecting center portions of the communication path 23 in cross sections orthogonal to the direction in which the communication path 23 extends will be the length L of the communication path 23 as described above. That is, a sum of lengths L1, L2 and L3 shown in FIG. 12 will be the length L of the communication path 23.

Further, in the shock absorber 1A6 according to the sixth variation, by bending the communication path 23 a plurality of times as described above, the opening 23*a* on the side of the shock absorbing portion and the opening 23*b* on the side of the tread are positioned such that they do not overlap each other as viewed in the direction of the normal to the tread 22. This configuration allows the communication path 23 to be a labyrinth to effectively prevent a foreign matter from reaching inside the shock absorbing portion 10.

Figure 13:
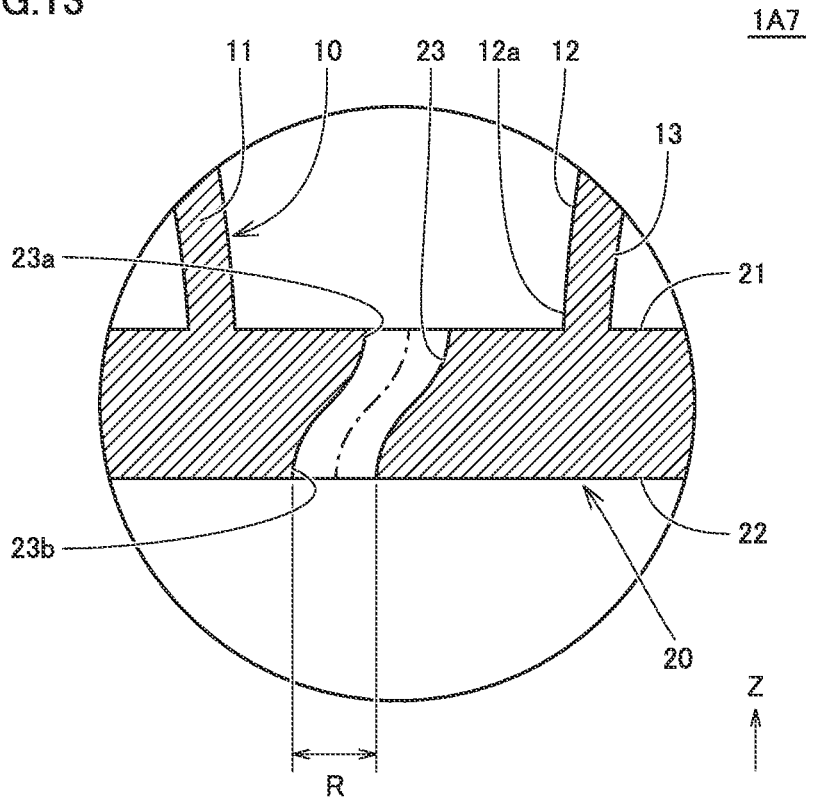
FIG. 13 is an enlarged cross section of a main portion of a shock absorber according to a seventh variation.

As shown in FIG. 13, the shock absorber 1A7 according to the seventh variation has the communication path 23 curved to extend in a direction intersecting the direction of the normal to the tread 22. This configuration, as well as the fourth variation described above, allows the communication path 23 to have a length L increased without increasing the cover portion 20 in thickness. This configuration can prevent deterioration in performance of and damage to the shock absorber without increasing the shock absorber in weight.

The communication path 23 curved as in the shock absorber 1A7 according to the seventh variation is also such that the length of the locus connecting center portions of the communication path 23 in cross sections orthogonal to the direction in which the communication path 23 extends (i.e., the length of a portion indicated by a dashed line in the figure) will be the length L of the communication path 23 as described above.

(Eighth to Twelfth Variations) FIGS. 14A to 14E are bottom views of main portions of shock absorbers according to eighth to twelfth variations, respectively. Hereinafter, shock absorbers 1A8 to 1A12 according to the eighth to twelfth variations based on the first embodiment described above will be described with reference to FIGS. 14A to 14E.

While in the first embodiment described above the communication path 23 provided in the cover portion 20 is in the form of a through hole in the form of a circle in plan view by way of example, the communication path 23 has an opening variable in shape in plan view. The eighth to twelfth variations described below exemplify a case in which the shock absorber 1A is thus modified.

As has been discussed above, from the viewpoint of reliably ejecting uncured resin in manufacturing the shock absorber, it is better that the communication path 23 has a larger opening area. On the other hand, from the viewpoint of preventing intrusion of foreign matters, it is better that the communication path 23 has a smaller widthwise dimension, considering that fine gravel assumed to be the foreign matter is basically generally spherical, as has been discussed above. In order to coestablish these, in the eighth to twelfth variations described below, the communication path 23 in plan view has an opening having a shape which is not round.

Figure 14A:
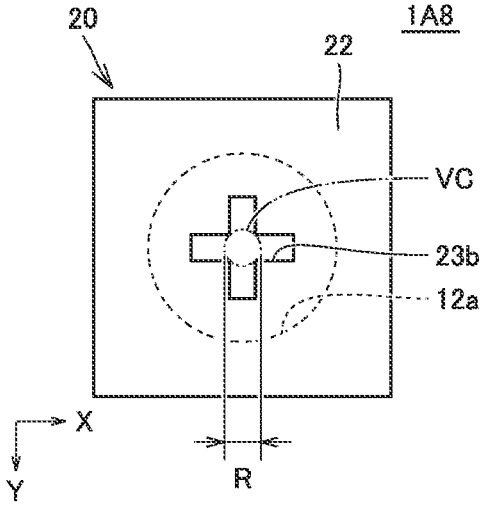
FIGS. 14A to 14E are bottom views of main portions of shock absorbers according to eighth to twelfth variations, respectively.

As shown in FIG. 14A, the shock absorber 1A8 according to the eighth variation has the communication path 23 with an opening in the form of a cross in plan view. That is, the communication path 23 has the opening 23*a* on the side of the shock absorbing portion and the opening 23*b* on the side of the tread both in the form of the cross, and the communication path 23 in cross section orthogonal to the direction in which the communication path 23 extends also has an opening in the form of the cross at any location.

Figure 14B:
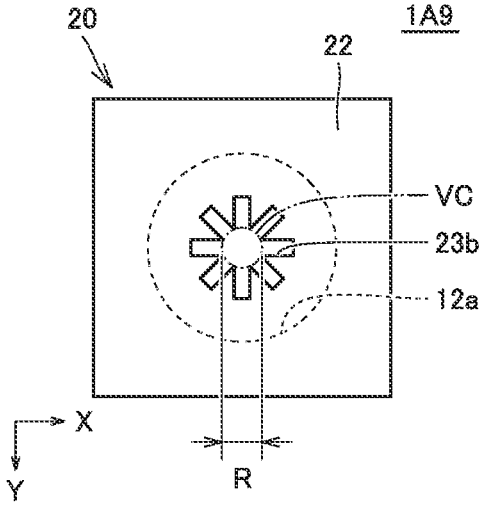

As shown in FIG. 14B, the shock absorber 1A9 according to the ninth variation has the communication path 23 with an opening in the form of an asterisk. That is, the communication path 23 has the opening 23*a* on the side of the shock absorbing portion and the opening 23*b* on the side of the tread both in the form of the asterisk, and the communication path 23 in cross section orthogonal to the direction in which the communication path 23 extends also has an opening in the form of the asterisk at any location.

Figure 14C:
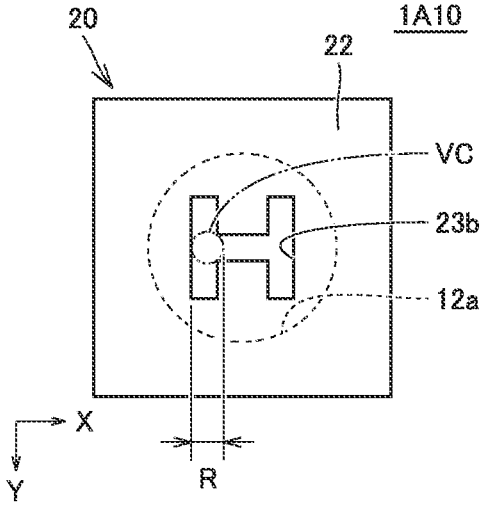

As shown in FIG. 14C, the shock absorber 1A10 according to the tenth variation has the communication path 23 with an opening in the form of a letter of H in plan view. That is, the communication path 23 has the opening 23*a* on the side of the shock absorbing portion and the opening 23*b* on the side of the tread both in the form of the letter of H, and the communication path 23 in cross section orthogonal to the direction in which the communication path 23 extends also has an opening in the form of the letter of H at any location.

Figure 14D:
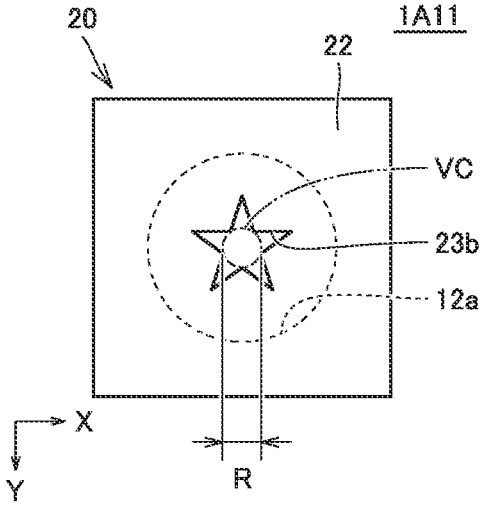

As shown in FIG. 14D, the shock absorber 1A11 according to the eleventh variation has the communication path 23 with an opening in the form of a star in plan view. That is, the communication path 23 has the opening 23*a* on the side of the shock absorbing portion and the opening 23*b* on the side of the tread both in the form of the star, and the communication path 23 in cross section orthogonal to the direction in which the communication path 23 extends also has an opening in the form of the star at any location.

Figure 14E:
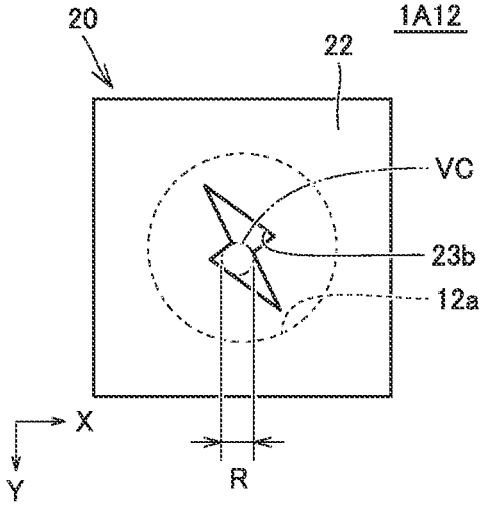

As shown in FIG. 14E, the shock absorber 1A12 according to the twelfth variation has the communication path 23 with an opening in a form designed with a lightening as a motif. That is, the communication path 23 has the opening 23*a* on the side of the shock absorbing portion and the opening 23*b* on the side of the tread both in the form designed with a lightening as a motif, and the communication path 23 in cross section orthogonal to the direction in which the communication path 23 extends also has an opening in the form designed with the lightening as a motif at any location.

Herein, in the shock absorbers 1A8 to 1A11 according to the eighth to twelfth variations described above, when a largest virtual circle VC is inscribed inside a contour line of the communication path 23 in a cross section orthogonal to the direction in which the communication path 23 extends (in the figure, the virtual circle VC is indicated by a two-dot chain line), the diameter R of the virtual circle and the length L of the communication path 23 satisfy a condition of R<L.

Thus, when the eighth to twelfth variations are applied, while the communication path 23 can have a large opening area, the communication path 23 can have a narrow, small widthwise dimension at least in one direction in the cross section orthogonal to the direction in which the communication path 23 extends. This configuration can provide a shock absorber capable of suppressing intrusion of foreign matters into the shock absorbing portion 10 while reliably ejecting uncured resin in manufacturing the shock absorber.

Note that in the shock absorber 1A according to the first embodiment described above, the communication path 23 has an opening in the form of a circle, and in that case, the virtual circle VC will completely overlap the contour line of the communication path 23 in the form of that circle. Thus, the shock absorber 1A according to the first embodiment described above will also satisfy a condition similar to the above-described condition satisfied by the shock absorbers 1A8 to 1A12 according to the eighth to twelfth variations described above.

Figure 15A:
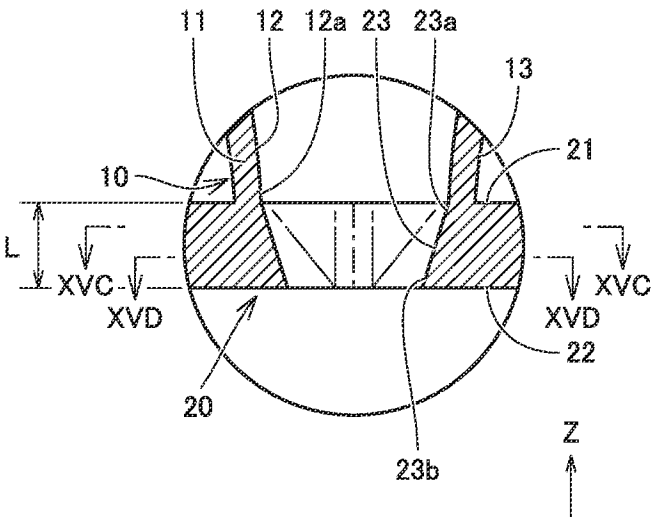
FIG. 15A is an enlarged cross section of a main portion of a shock absorber according to a thirteenth variation.
Figure 15B:
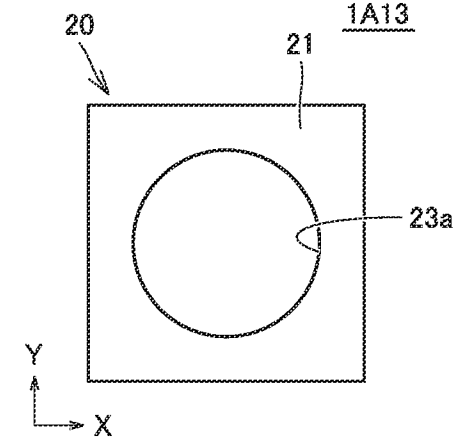
FIG. 15B is a plan view of the main portion of the shock absorber according to the thirteenth variation.
Figure 15C:
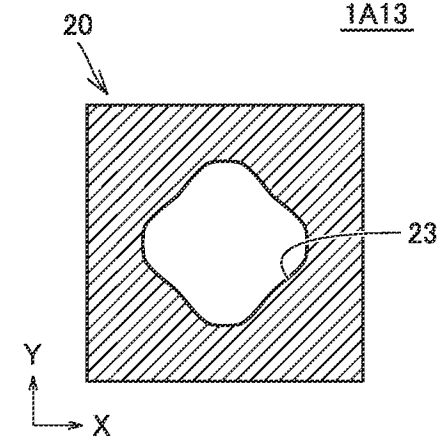
FIGS. 15C and 15D are cross sections of the main portion of the shock absorber according to the thirteenth variation.
Figure 15D:
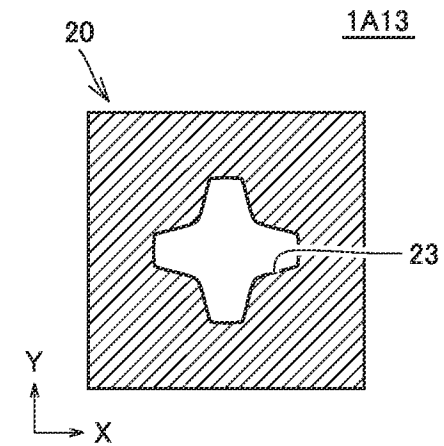
Figure 15E:
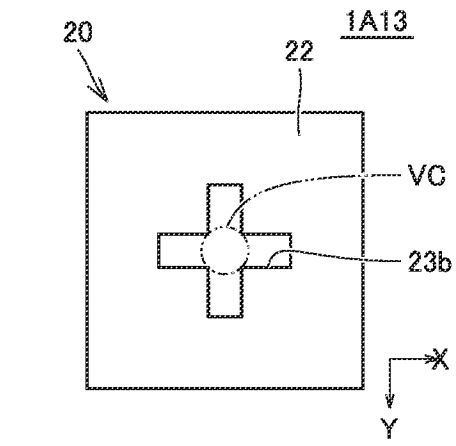
FIG. 15E is a bottom view of the main portion of the shock absorber according to the thirteenth variation.

(Thirteenth Variation) FIGS. 15A to 15E are an enlarged cross section, a plan view, cross sections and a bottom view showing a main portion of a shock absorber according to a thirteenth variation. More specifically, FIG. 15A is an enlarged cross section of a portion provided with a communication path, and FIG. 15B is a plan view of a cover portion provided with a communication path. FIGS. 15C and 15D are cross sections taken along a line XVC-XVC and a line XVD-XVD, respectively, shown in FIG. 15A, and FIG. 15E is a bottom view of a portion of the cover portion 20 provided with a communication path. Hereinafter, a shock absorber 1A13 according to the thirteenth variation based on the above-described first embodiment will be described with reference to FIGS. 15A to 15E.

While in the first and eighth to twelfth variations described above is described an example in which the cover portion 20 is provided with a communication path 23 that has the opening 23*a* on the side of the shock absorbing portion and the opening 23*b* on the side of the tread identically in shape and that, in a cross section orthogonal to the direction in which the communication path 23 extends, also has an opening identical in shape to the opening 23*a* on the side of the shock absorbing portion and the like, these openings can be configured to be variable in shape. A thirteenth variation described below exemplifies a case in which the shock absorber 1A is thus modified.

As shown in FIGS. 15A to 15E, in a shock absorber 1A13 according to the thirteenth variation, the communication path 23 has the opening 23*a* on the side of the shock absorbing portion in the form of a circle in plan view and the opening 23*b* on the side of the tread in the form of a cross in plan view, and has a portion connecting the opening 23*a* on the side of the shock absorbing portion and the opening 23*b* on the side of the tread in a form smoothly interconnecting the opening 23*a* on the side of the shock absorbing portion and the opening 23*b* on the side of the tread.

When intrusion of a foreign matter through the opening 23*b* on the side of the tread of the communication path 23 is considered, and the communication path 23 has a widthwise dimension narrowed and reduced while having an opening increased in area, at least the diameter R of a largest virtual circle VC inscribed inside the contour line of the opening 23*b* on the side of the tread (in FIG. 15E, the virtual circle VC is indicated by a two-dot chain line) and the length L of the communication path 23 satisfying the condition of R<L, suffice.

This configuration can effectively suppress intrusion of foreign matters into the shock absorbing portion 10 while reliably ejecting uncured resin in manufacturing the shock absorber.

Figure 16:
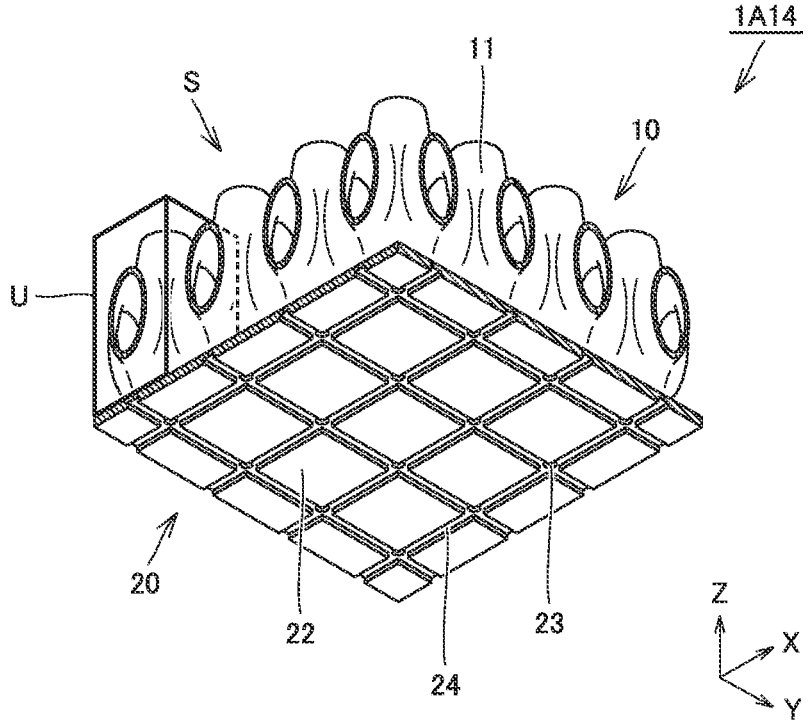
FIG. 16 is a perspective view of a shock absorber according to a fourteenth variation.

(Fourteenth Variation) FIG. 16 is a perspective view of a shock absorber according to a fourteenth variation. Hereinafter, a shock absorber 1A14 according to the fourteenth variation based on the above-described first embodiment will be described with reference to FIG. 16. As well as in first embodiment, the shock absorber 1A14 according to the fourteenth variation is also configured such that the diameter R of the opening 23*b* on the side of the tread and the length L of the communication path 23 satisfy the condition of R<L.

As shown in FIG. 16, the shock absorber 1A14 according to the fourteenth variation includes the cover portion 20 having the tread 22 with a plurality of grooves 24 intersecting one another. The plurality of grooves 24 correspond to a tread pattern which provides enhanced grip.

Herein, the plurality of communication paths 23 described above have the opening 23*b* on the side of the tread inside the plurality of grooves 24 such that the plurality of communication paths 23 are externally exposed at a portion provided with the plurality of grooves 24. More specifically, in the fourteenth variation, the plurality of grooves 24 are laid out generally in the form a lattice, and the communication path 23 is positioned at an intersection of the plurality of grooves 24.

In such a configuration, the communication path 23 will have the opening 23*b* on the side of the tread at a position deeper than the tread 22. This increases a distance from the tread 22 to the opening 23*b* on the side of the tread, and can thus further suppress intrusion of foreign matters. In providing the tread 22 of the cover portion 20 with a tread pattern, the tread pattern can be changed variously.

When the cover portion has a tread provided with a groove, a recess or the like and a communication path is provided in a bottom surface of the groove, recess or the like, the groove, recess or the like is also a part of a path allowing a foreign matter to reach the shock absorbing portion from the tread. Therefore, when such a configuration is introduced, the diameter R of the virtual circle is defined with reference to the opening on the side of the tread that is provided in the bottom surface of the groove, recess or the like, whereas the length L of the communication path is defined as the sum of the depth of the groove, recess or the like and the actual length of the communication path.

Figure 17:
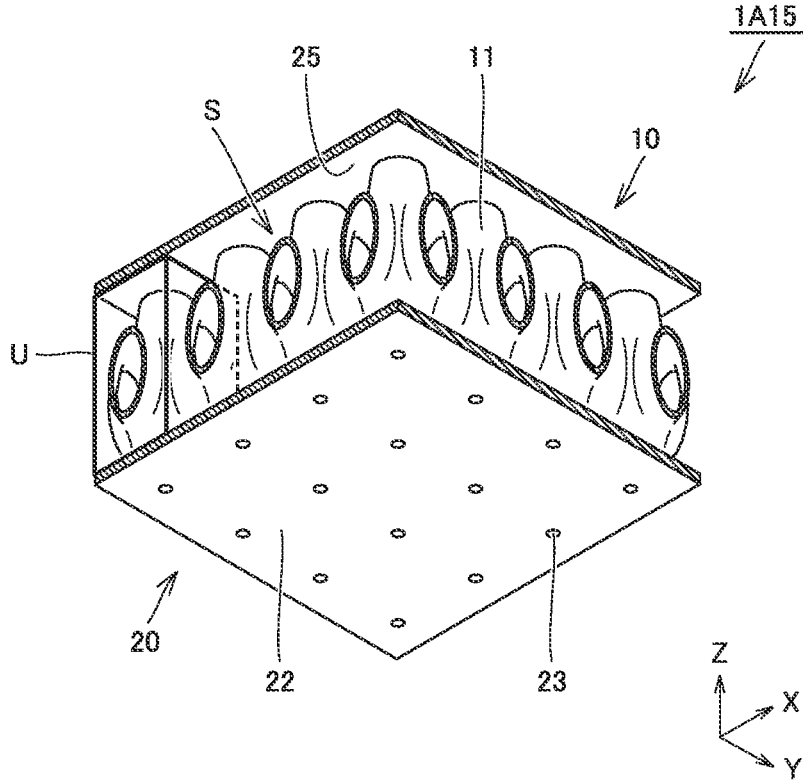
FIG. 17 is a perspective view of a shock absorber according to a fifteenth variation.

(Fifteenth Variation) FIG. 17 is a perspective view of a shock absorber according to a fifteenth variation. Hereinafter, a shock absorber 1A15 according to the fifteenth variation based on the first embodiment will be described with reference to FIG. 17. As well as in first embodiment, the shock absorber 1A15 according to the fifteenth variation is also configured such that the diameter R of the opening 23*b* on the side of the tread and the length L of the communication path 23 satisfy the condition of R<L.

As shown in FIG. 17, the shock absorber 1A15 according to the fifteenth variation includes the shock absorbing portion 10 and the cover portion 20, and in addition thereto, an auxiliary attachment portion 25. The auxiliary attachment portion 25 is formed of a portion having the same shape as the cover portion 20 and, although not shown in FIG. 17, provided generally in the form of a plate having a plurality of portions each in the form of a through hole identical in shape and layout to the communication path 23 that the cover portion 20 has.

The auxiliary attachment portion 25 is disposed at a position opposite to the cover portion 20 when viewed at the shock absorbing portion 10, and is stacked on the shock absorbing portion 10 in the direction of the normal to the tread 22 provided on the cover portion 20. Thus, the shock absorbing portion 10 has a top surface covered with the auxiliary attachment portion 25, and the shock absorbing portion 10 is located under the auxiliary attachment portion 25. The shock absorber 1A is a single member formed of the shock absorbing portion 10, the cover portion 20 and the auxiliary attachment portion 25 continuously connected together.

The auxiliary attachment portion 25 is a portion for fixing the shock absorber 1A14 to the midsole 111 by adhesion or the like, and is provided so as to cover the top surface of the shock absorbing portion 10 in view of increasing an area for bonding it. Providing the auxiliary attachment portion 25 having a portion in the form of a plurality of through holes enables larger bonding strength than not providing such a portion. Further, providing the midsole 111 with a projection corresponding to each portion in the form of the through hole facilitates positioning the shock absorber 1A14 with respect to the midsole 111 in fixing the shock absorber 1A14 to the midsole 111.

Figure 18:
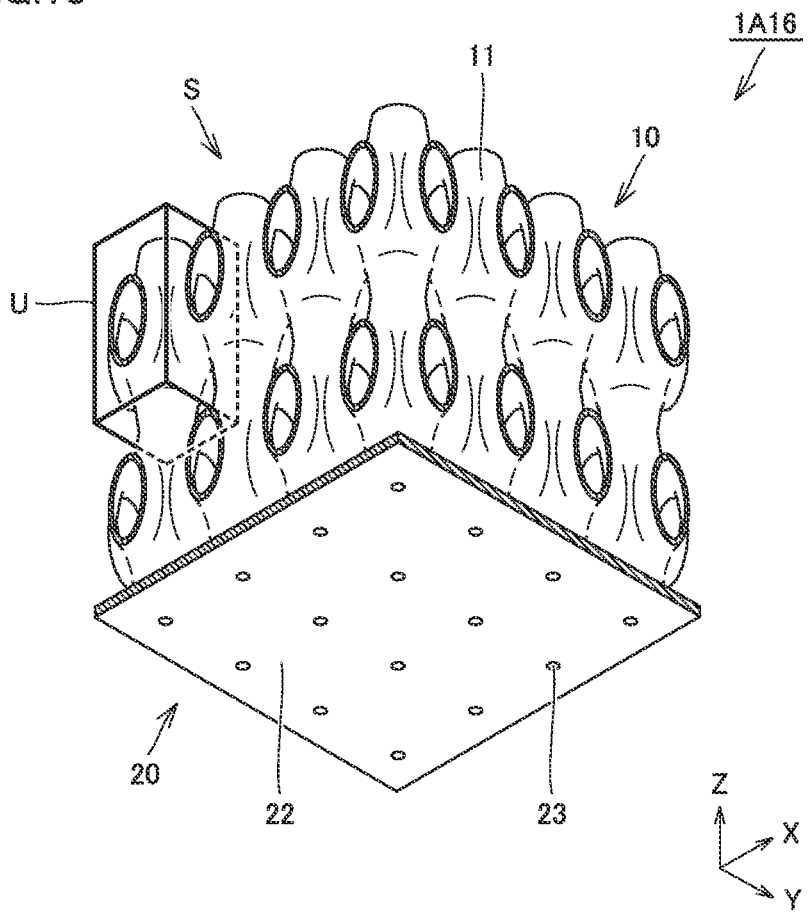
FIG. 18 is a perspective view of a shock absorber according to a sixteenth variation.

(Sixteenth Variation) FIG. 18 is a perspective view of a shock absorber according to a sixteenth variation. Hereinafter, a shock absorber 1A16 according to the sixteenth variation based on the first embodiment will be described with reference to FIG. 18. As well as in first embodiment, the shock absorber 1A16 according to the sixteenth variation is also configured such that the diameter R of the opening 23*b* on the side of the tread and the length L of the communication path 23 satisfy the condition of R<L.

As shown in FIG. 18, the shock absorber 1A16 according to the sixteenth variation has two unit structures U aligned in the heightwise direction or the Z direction. Such a configuration will also provide the shock absorber 1A16 with the above-described first and second pass-through portions 12 and 13 passing through the shock absorbing portion 10 due to the structure of the three-dimensional structure S when viewed in the direction of the normal to the tread 22.

Accordingly, when the shock absorber 1A16 according to the sixteenth variation is provided with a cover portion 20 having a configuration similar to that in the case of the first embodiment as described above, the shock absorber 1A16 can prevent a foreign matter from entering and thus inviting damage to the shock absorber 1A16 or deterioration thereof in performance.

Second Embodiment

Figure 19:
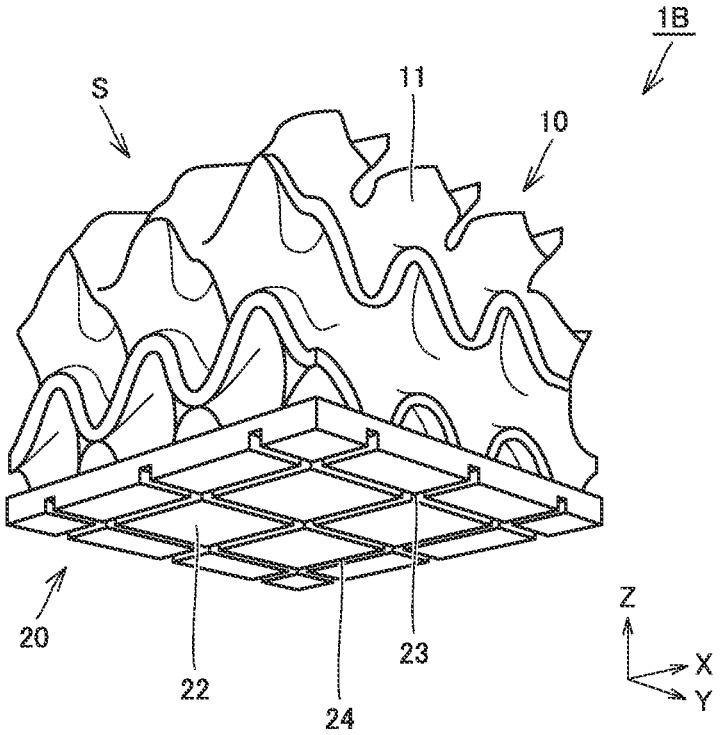
FIG. 19 is a perspective view of a shock absorber according to a second embodiment.

FIG. 19 is a perspective view of a shock absorber according to a second embodiment. A shock absorber 1B according to the present embodiment will be described below with reference to FIG. 19. The shock absorber 1B according to the present embodiment is provided in the shoe sole 110 according to the first embodiment instead of the shock absorber 1A according to the first embodiment.

As shown in FIG. 19, the shock absorber 1B according to the present embodiment is different from the shock absorber 1A according to the first embodiment only in the configuration of the shock absorbing portion 10. Specifically, the shock absorber 1B according to the present embodiment is configured such that the three-dimensional structure S having a three-dimensional shape formed by the wall 11 having an external shape defined by a pair of parallel, geometrical curved surfaces is a gyroid structure with a thickness added thereto.

The shock absorbing portion 10 composed of the three-dimensional structure S that is a gyroid structure with a thickness added thereto will also be provided with a pass-through portion passing through the shock absorbing portion 10 due to its structure when viewed in the direction of the normal to the tread 22. The shock absorber 1B as shown has three unit structures aligned in each of the widthwise direction or the X direction and the depthwise direction or the Y direction, and has one unit structure disposed in the heightwise direction or the Z direction.

Thus, providing the cover portion 20 so as to cover the bottom surface of the shock absorbing portion 10 and providing a communication path 23 similar in configuration to that for the shock absorber 1A according to the first embodiment at a portion of the cover portion 20 corresponding to the pass-through portion described above, as in the shock absorber 1B according to the present embodiment, can suppress intrusion of foreign matters into the shock absorbing portion 10 while reliably ejecting uncured resin in manufacturing the shock absorber.

Third Embodiment

Figure 20:
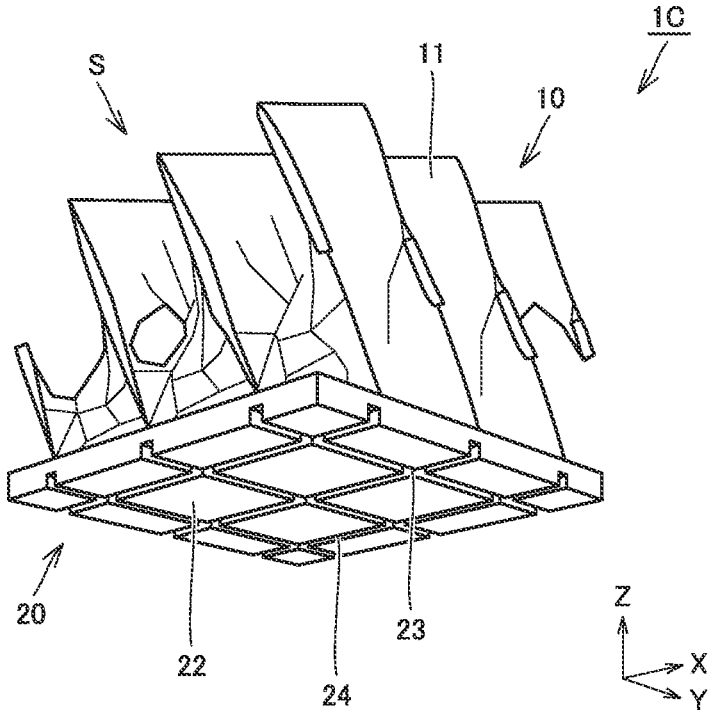
FIG. 20 is a perspective view of a shock absorber according to a third embodiment.

FIG. 20 is a perspective view of a shock absorber according to a third embodiment. A shock absorber 1C according to the present embodiment will be described below with reference to FIG. 20. The shock absorber 1C according to the present embodiment is provided in the shoe sole 110 according to the first embodiment instead of the shock absorber 1A according to the first embodiment.

As shown in FIG. 20, the shock absorber 1C according to the present embodiment is different from the shock absorber 1A according to the first embodiment only in the configuration of the shock absorbing portion 10. Specifically, the shock absorber 1C according to the present embodiment is configured such that the shock absorbing portion 10 has a three-dimensional structure S having a three-dimensional shape formed by the wall 11 having an external shape defined by a pair of parallel, geometrical curved surfaces, that is a Schwarz' D structure with a thickness added thereto.

The shock absorbing portion 10 composed of the three-dimensional structure S that is a Schwarz' D structure with a thickness added thereto will also be provided with a pass-through portion passing through the shock absorbing portion 10 due to its structure when viewed in the direction of the normal to the tread 22. The shock absorber 1C as shown has three unit structures aligned in each of the widthwise direction or the X direction and the depthwise direction or the Y direction, and has one unit structure disposed in the heightwise direction or the Z direction.

Thus, providing the cover portion 20 so as to cover the bottom surface of the shock absorbing portion 10 and providing a communication path 23 similar in configuration to that for the shock absorber 1A according to the first embodiment at a portion of the cover portion 20 corresponding to the pass-through portion described above, as in the shock absorber 1C according to the present embodiment, can suppress intrusion of foreign matters into the shock absorbing portion 10 while reliably ejecting uncured resin in manufacturing the shock absorber.

Fourth Embodiment

Figure 21:
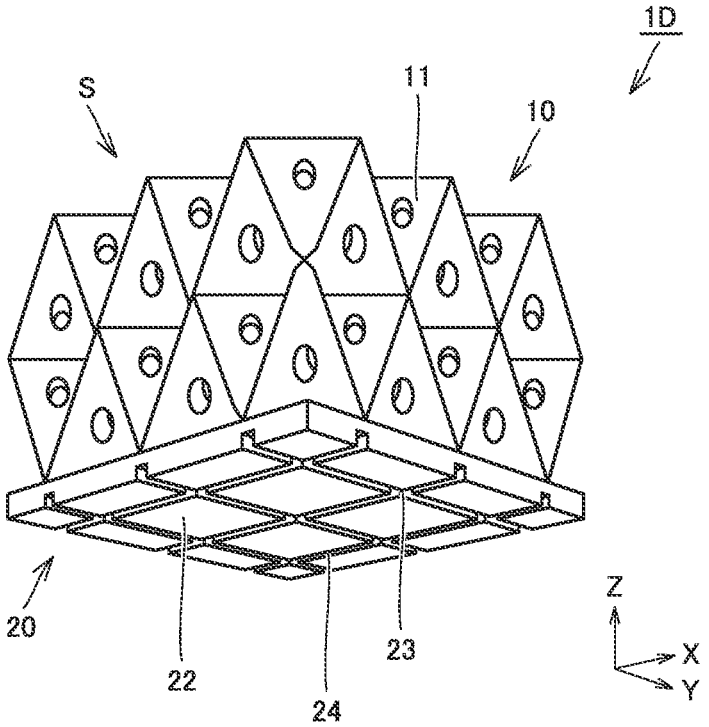
FIG. 21 is a perspective view of a shock absorber according to a fourth embodiment.

FIG. 21 is a perspective view of a shock absorber according to a fourth embodiment. A shock absorber 1D according to the present embodiment will be described below with reference to FIG. 21. The shock absorber 1D according to the present embodiment is provided in the shoe sole 110 according to the first embodiment instead of the shock absorber 1A according to the first embodiment.

As shown in FIG. 21, the shock absorber 1D according to the present embodiment is different from the shock absorber 1A according to the first embodiment only in the configuration of the shock absorbing portion 10. Specifically, the shock absorber 1D according to the present embodiment is configured such that the shock absorbing portion 10 is composed of a three-dimensional structure S having a three-dimensional shape formed by a wall 11 having an external shape defined by a pair of parallel, geometrical planes, and the three-dimensional structure S is formed of a plurality of planes disposed so as to intersect one another and provided with thickness such that the three-dimensional structure S is internally hollowed. The three-dimensional structure S shown is an octet structure with a thickness added thereto.

The shock absorbing portion 10 composed of the three-dimensional structure S that is an octet structure with a thickness added thereto requires providing the wall 11 with a hole passing through the wall 11 to eject uncured resin in manufacturing the shock absorber. Accordingly, the shock absorbing portion 10 will be provided with a pass-through portion passing through the shock absorbing portion 10 as viewed in the direction of the normal to the tread 22. The shock absorber 1D as shown has three unit structures aligned in each of the widthwise direction or the X direction and the depthwise direction or the Y direction, and has one unit structure disposed in the heightwise direction or the Z direction.

Thus, providing the cover portion 20 so as to cover the bottom surface of the shock absorbing portion 10 and providing a communication path 23 similar in configuration to that for the shock absorber 1A according to the first embodiment at a portion of the cover portion 20 corresponding to the pass-through portion described above, as in the shock absorber 1D according to the present embodiment, can suppress intrusion of foreign matters into the shock absorbing portion 10 while reliably ejecting uncured resin in manufacturing the shock absorber.

Fifth Embodiment

Figure 22:
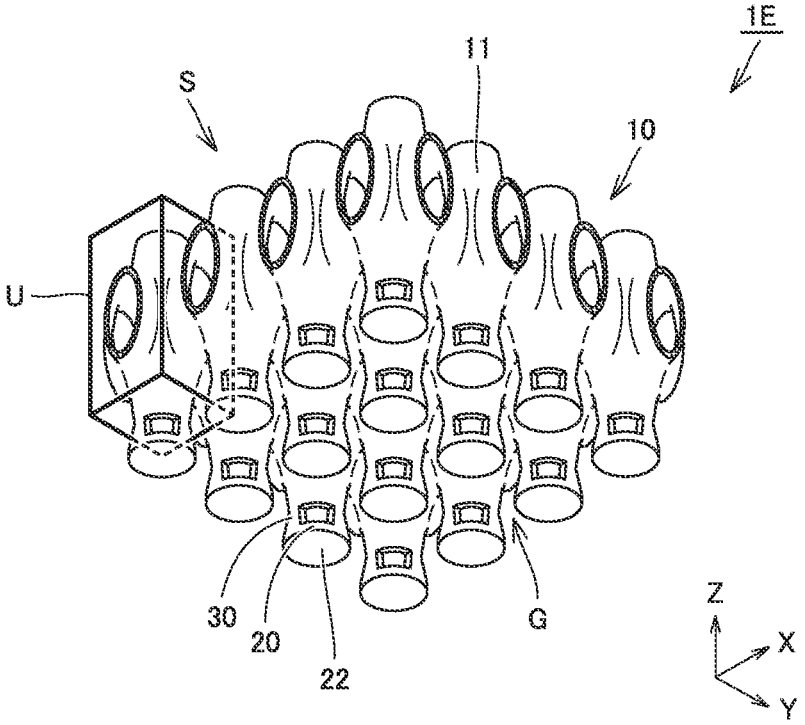
FIG. 22 is a perspective view of a shock absorber according to a fifth embodiment.
Figure 23B:
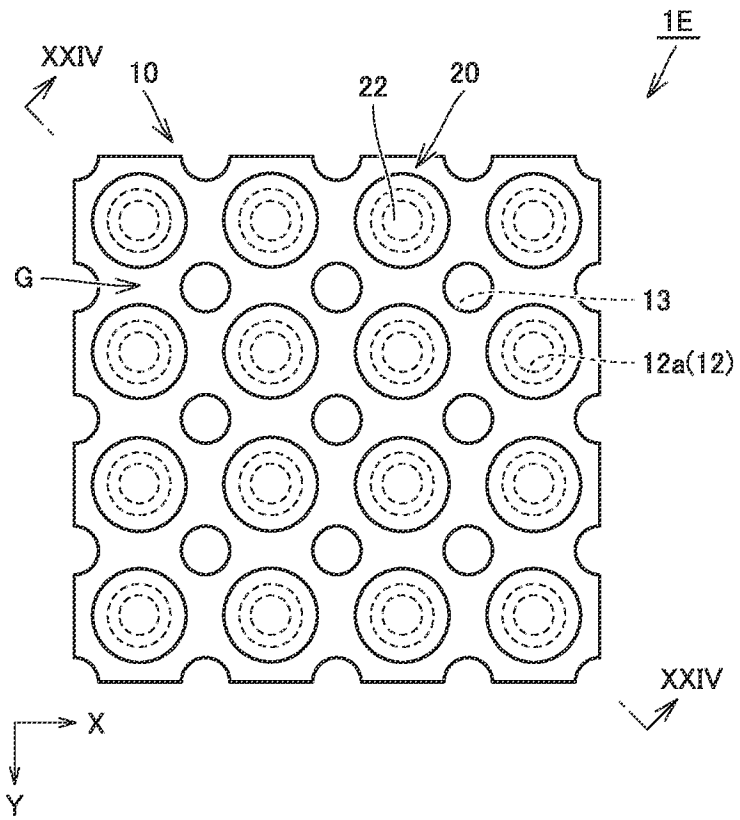
FIG. 23B is a bottom view of the FIG. 22 shock absorber as a whole.
Figure 23A:
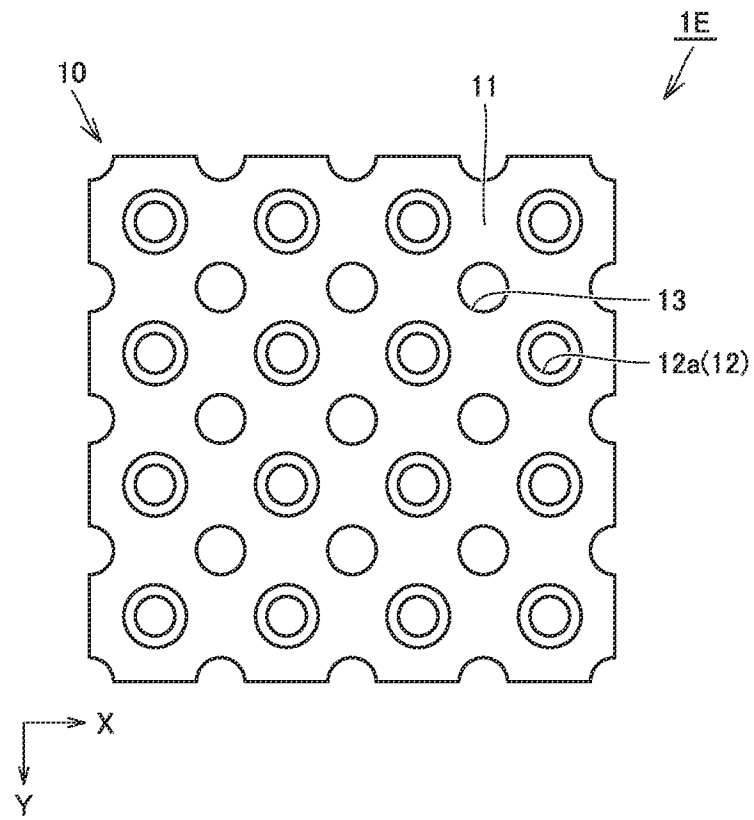
FIG. 23A is a bottom view of the FIG. 22 shock absorber with a cover portion removed.
Figure 24:
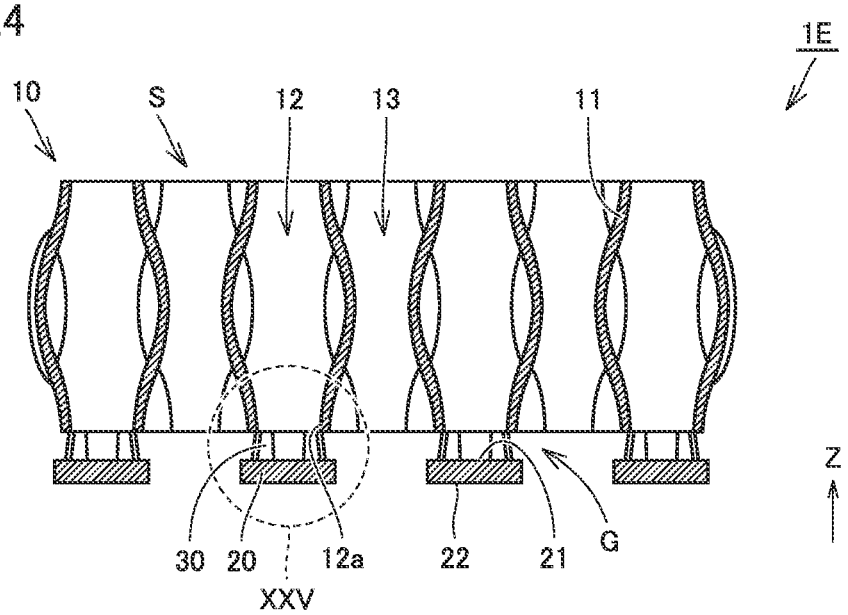
FIG. 24 is a cross section of the shock absorber shown in FIG. 22.
Figure 25:
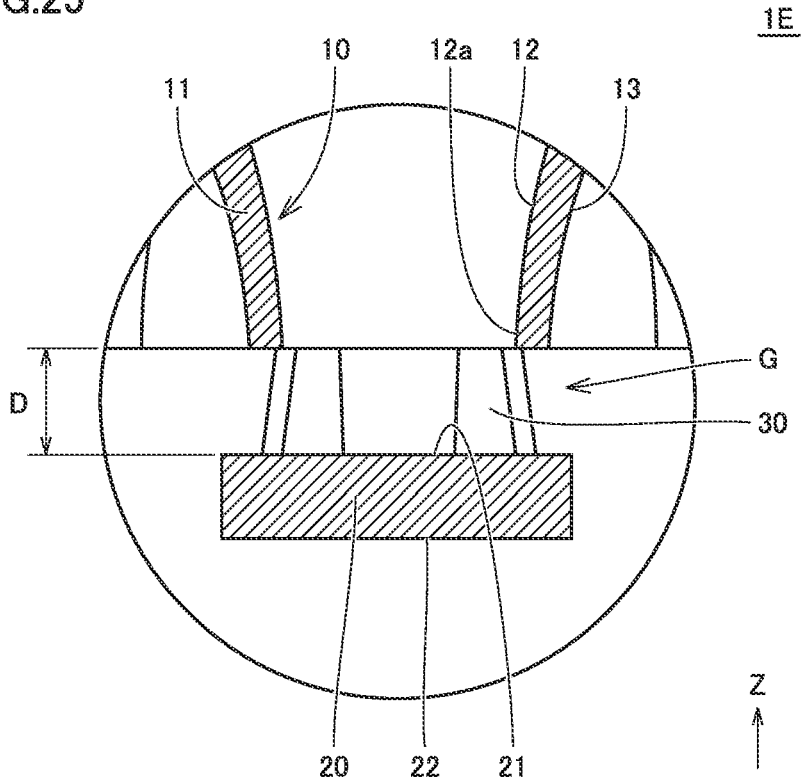
FIG. 25 is an enlarged cross section of a main portion of the FIG. 22 shock absorber.

FIG. 22 is a perspective view of a shock absorber according to a fifth embodiment. FIGS. 23A and 23B are bottom views of a shock absorbing portion of the shock absorber shown in FIG. 22, and FIG. 23A is a bottom view of the shock absorber with a cover portion removed (that is, a bottom view of the shock absorbing portion) and FIG. 23B is a general bottom view of the shock absorber including the shock absorbing portion and the cover portion. FIG. 24 is a cross section taken along a line XXIV-XXIV shown in FIG. 23B and FIG. 25 is an enlarged cross section of a region XXV shown in FIG. 24. Hereinafter, a shock absorber 1E according to the present embodiment will be described with reference to FIGS. 22 to 25. The shock absorber 1E according to the present embodiment is provided in the shoe sole 110 according to the first embodiment instead of the shock absorber 1A according to the first embodiment.

As shown in FIGS. 22 to 25, the shock absorber 1E according to the present embodiment differs in configuration from the shock absorber 1A according to the first embodiment in that the former has the cover portion 20 configured differently than the latter and that the former includes a columnar portion 30 in addition to the shock absorbing portion 10 and the cover portion 20.

As shown in FIGS. 22, 23B, 24, and 25, the cover portion 20 is disposed at a position lower than the bottom surface of the shock absorbing portion 10, and the columnar portion 30 is positioned between the shock absorbing portion 10 and the cover portion 20 so as to interconnect the shock absorbing portion 10 and the cover portion 20. The shock absorber 1E is a single member formed of the shock absorbing portion 10, the cover portion 20 and the columnar portion 30 continuously connected together.

In the present embodiment, a single cover portion 20 is provided to correspond to each of unit structures U included in the shock absorbing portion 10, and a plurality of columnar portions 30 are provided so as to each connect the corresponding set of the unit structure U and the cover portion 20. Accordingly, a plurality of cover portions 20 will be disposed in a matrix so as to cover a plurality of first open ends 12*a* provided in the bottom surface of the shock absorbing portion 10.

The plurality of cover portions 20 are each in the form of a disc, and each have an upper surface configured as the connected surface 21 (see FIG. 24 in particular) and a lower surface configured as the tread 22. The plurality of cover portions 20 each have a size that completely covers the first open end 12*a* located in the bottom surface of the corresponding unit structure U.

The plurality of columnar portions 30 each extend downward independently from a peripheral edge of a lower end of the unit structure U, and have an end connected to a peripheral edge of the cover portion 20. In the present embodiment, the plurality of columnar portions 30 are each configured to be generally in the form of a plate.

In the shock absorber 1E configured as described above, while the plurality of cover portions 20 and the plurality of columnar portions 30 are disposed under the shock absorbing portion 10, a gap G is formed between the shock absorbing portion 10 and the plurality of cover portions 20 and the plurality of columnar portions 30. Accordingly, the gap G configures a path for ejecting uncured resin in manufacturing the shock absorber.

Meanwhile, as has been discussed above, the plurality of cover portions 20 are each located under the corresponding unit structure U and covers the first open end 12*a* located at the bottom surface of the corresponding unit structure U. Accordingly, when the shock absorber 1E is viewed in the direction of the normal to the tread 22, the plurality of first pass-through portions 12 included in the shock absorbing portion 10 are all covered with the corresponding cover portions 20. Therefore, the plurality of first pass-through portions 12 are not directly, externally exposed in the direction of the normal to the tread 22, and a foreign matter immediately reaching inside the shock absorbing portion 10 will be avoided.

In view of reliably ejecting uncured resin in manufacturing the shock absorber and that a sufficiently fine foreign matter is unlikely to lead to deterioration in performance or to damage as described above if it should enter the shock absorber 1E, with reference to FIG. 25, a distance D between the bottom surface of the shock absorbing portion 10 and the connected surface 21 of the cover portion 20 is preferably 0.8 mm or more and 15.0 mm or less, more preferably 1.0 mm or more and 10 mm or less.

Thus a shoe sole comprising the shock absorber 1E according to the present embodiment and a shoe comprising the shoe sole can prevent a foreign matter from entering and inviting damage to the shock absorber 1E or deterioration thereof in performance.

Sixth Embodiment

Figure 26:
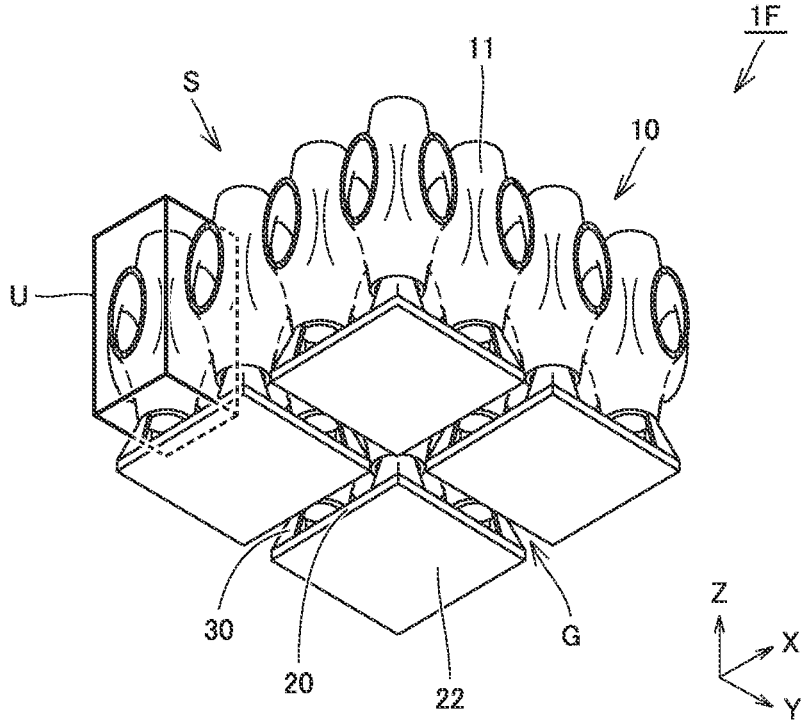
FIG. 26 is a perspective view of a shock absorber according to a sixth embodiment.
Figure 27B:
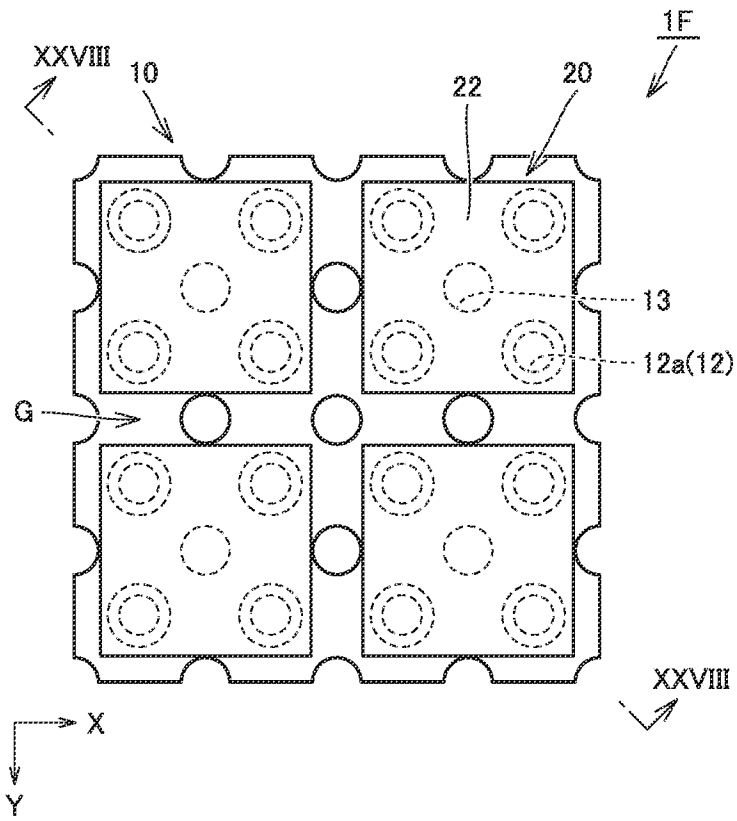
FIG. 27B is a bottom view of the FIG. 26 shock absorber as a whole.
Figure 27A:
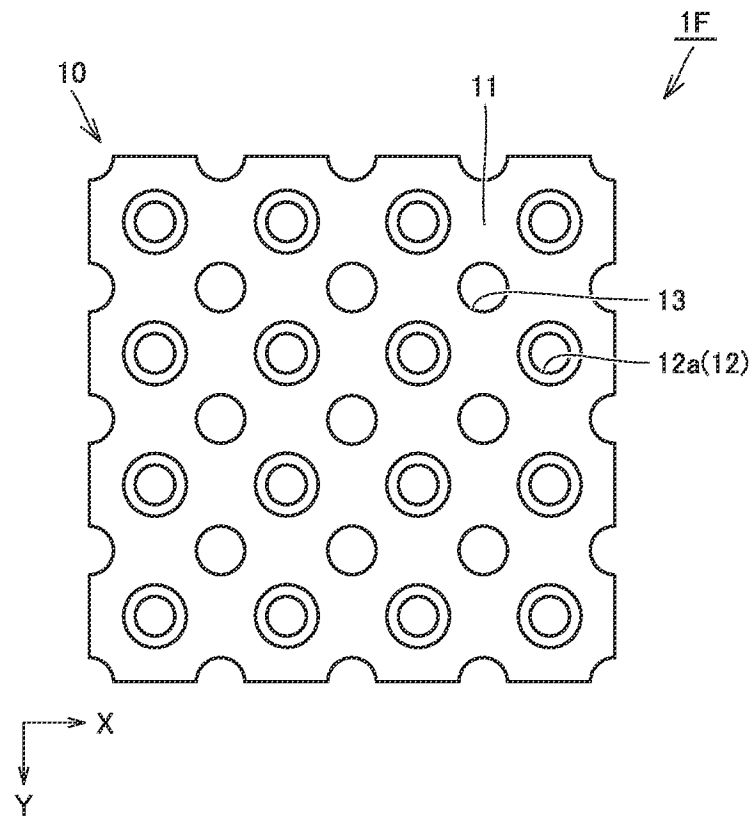
FIG. 27A is a bottom view of the FIG. 26 shock absorber with a cover portion removed.
Figure 28:
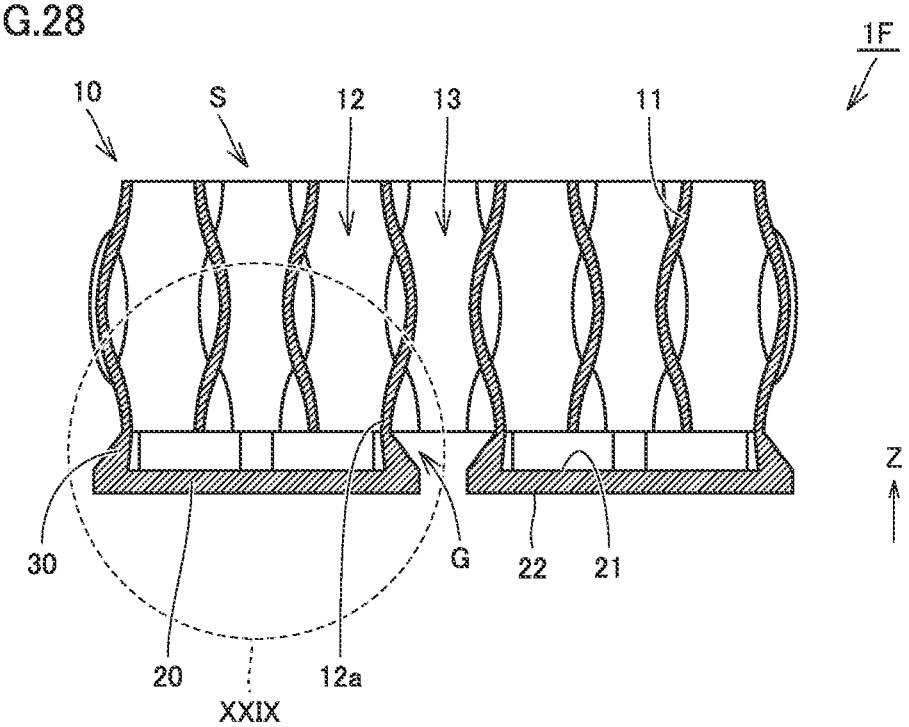
FIG. 28 is a cross section of the shock absorber shown in FIG. 26.
Figure 29:
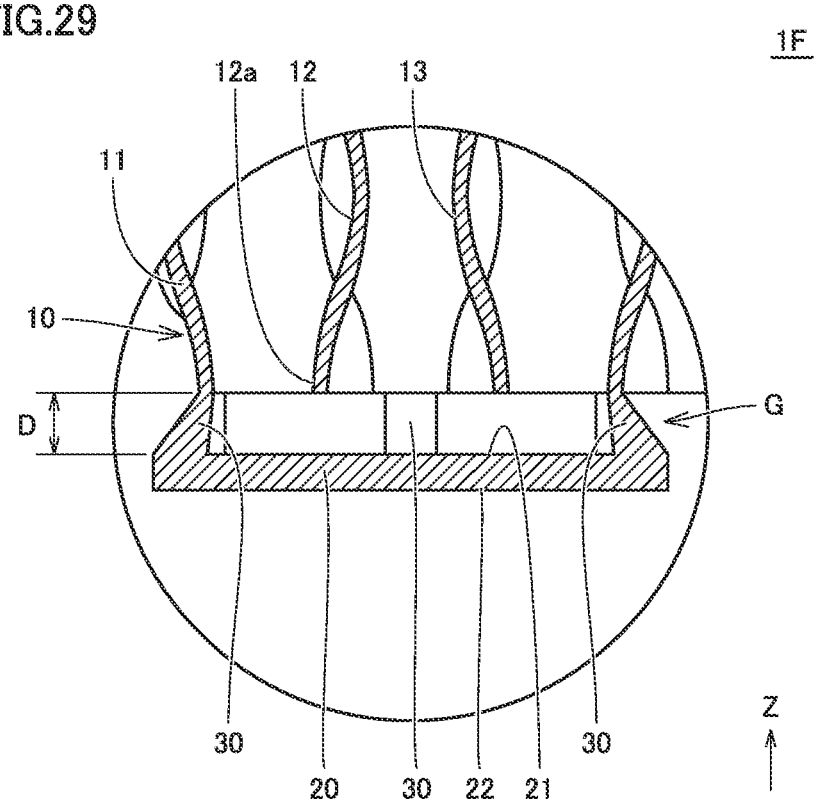
FIG. 29 is an enlarged cross section of a main portion of the FIG. 26 shock absorber.

FIG. 26 is a perspective view of a shock absorber according to a sixth embodiment. FIGS. 27A and 27B are bottom views of a shock absorbing portion of the shock absorber shown in FIG. 26, and FIG. 27A is a bottom view of the shock absorber with a cover portion removed (that is, a bottom view of the shock absorbing portion) and FIG. 27B is a general bottom view of the shock absorber including the shock absorbing portion and the cover portion. FIG. 28 is a cross section taken along a line XXVIII-XXVIII indicated in FIG. 27B, and FIG. 29 is an enlarged cross section of a region XXIX shown in FIG. 28. Hereinafter, a shock absorber 1F according to the present embodiment will be described with reference to FIGS. 26 to 29. The shock absorber 1F according to the present embodiment is provided in the shoe sole 110 according to the first embodiment instead of the shock absorber 1A according to the first embodiment.

As shown in FIGS. 26 to 29, the shock absorber 1F according to the present embodiment is different from the shock absorber 1E according to the fifth embodiment only in how the cover portion 20 and the columnar portion 30 are configured. Specifically, in the shock absorber 1F according to the present embodiment, a single cover portion 20 is provided to correspond to a plurality of the unit structures U included in the shock absorbing portion 10, and a plurality of columnar portions 30 are provided so as to connect a corresponding set of the plurality of unit structures U and the single cover portion 20.

In the shock absorber 1F according to the present embodiment, the plurality of cover portions 20 are configured to be in the form of a rectangular plate in plan view, and the plurality of columnar portions 30 are formed to extend upward from a peripheral edge of each of the plurality of cover portions 20 and each have an end connected to a lower end of one of the plurality of unit structures U. Further, the plurality of columnar portions 30 are each generally in the form of a triangular pyramid.

When such a configuration is introduced, then, as shown in FIG. 27B in particular, the plurality of cover portions 20 are each provided across a plurality of unit structures U, and accordingly, some of the plurality of second pass-through portions 13 will be covered with the plurality of cover portions 20. Therefore, by adopting this configuration, of the pass-through portions included in the shock absorbing portion 10, none of the plurality of first pass-through portions 12 will be directly externally exposed in the direction of the normal to the tread 22, and furthermore, of the pass-through portions included in the shock absorbing portion 10, some of the plurality of second pass-through portions 13 will not be directly externally exposed in the direction of the normal to the tread 22.

Thus a shoe sole comprising the shock absorber 1F according to the present embodiment and a shoe comprising the shoe sole can prevent a foreign matter from entering and inviting damage to the shock absorber 1F or deterioration thereof in performance.

Seventh Embodiment

Figure 30:
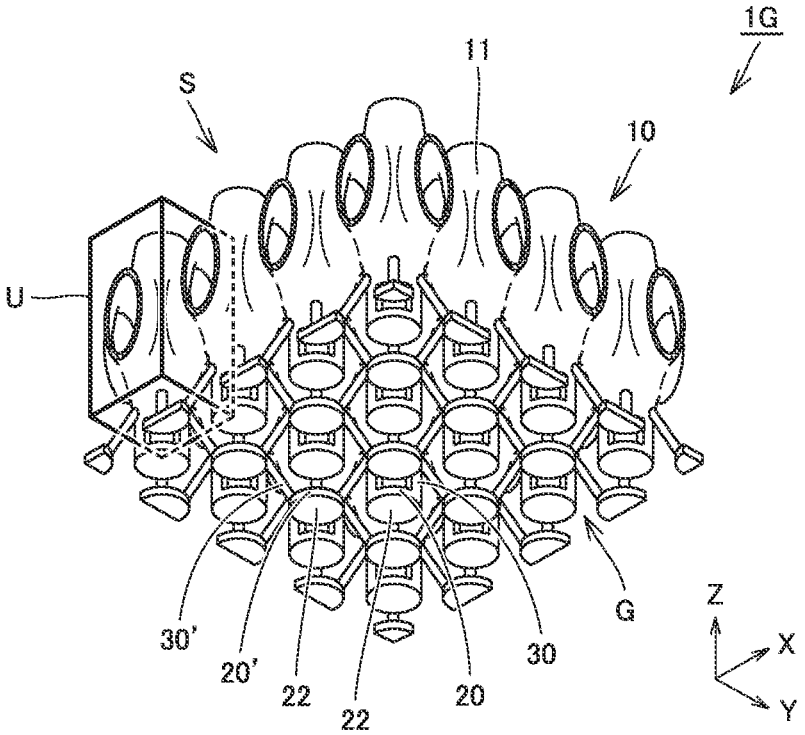
FIG. 30 is a perspective view of a shock absorber according to a seventh embodiment.
Figure 31B:
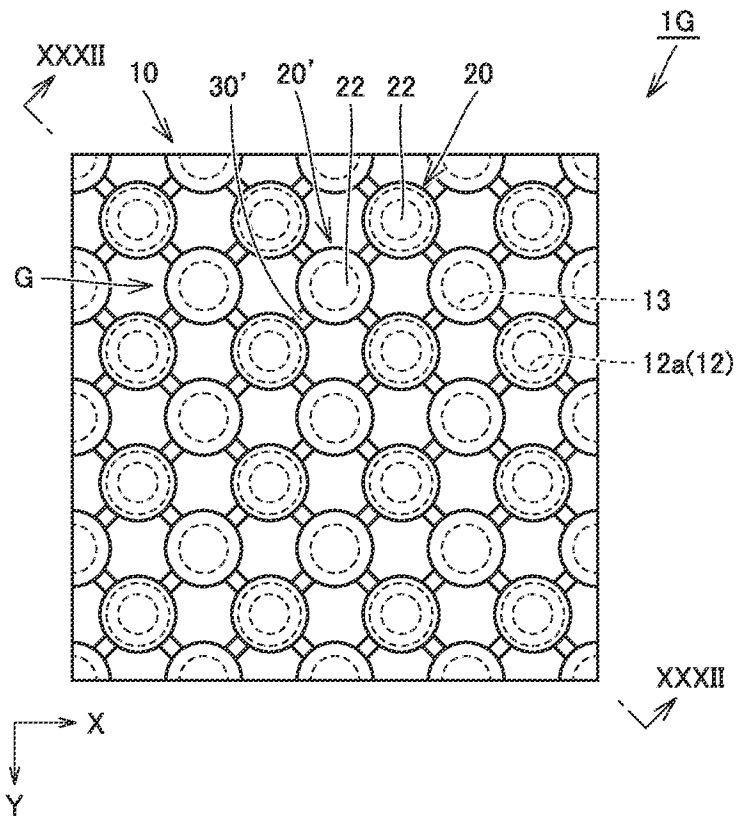
FIG. 31B is a bottom view of the FIG. 30 shock absorber as a whole.
Figure 31A:
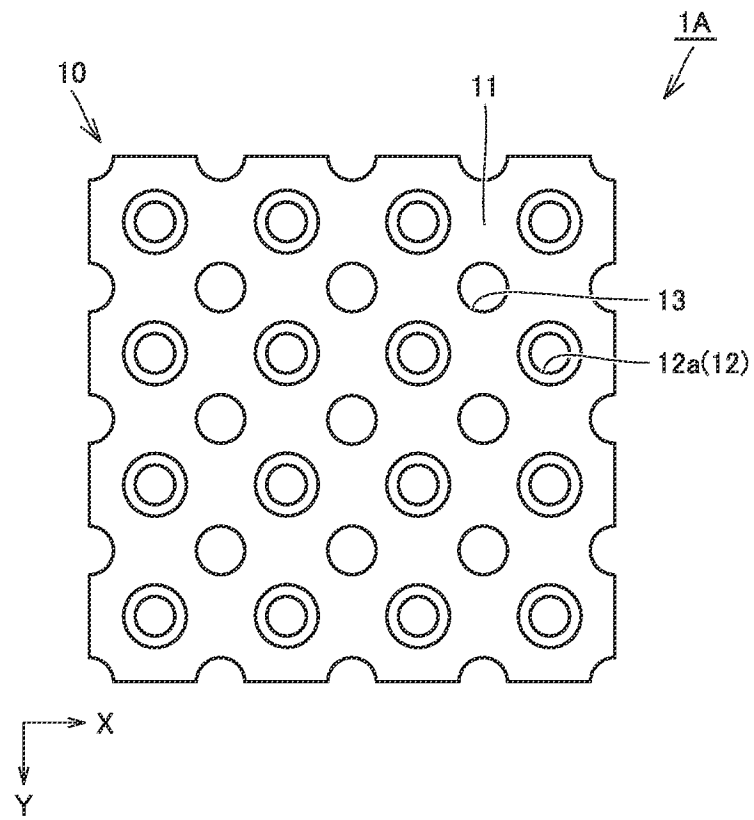
FIG. 31A is a bottom view of the FIG. 30 shock absorber with a cover portion removed.
Figure 32:
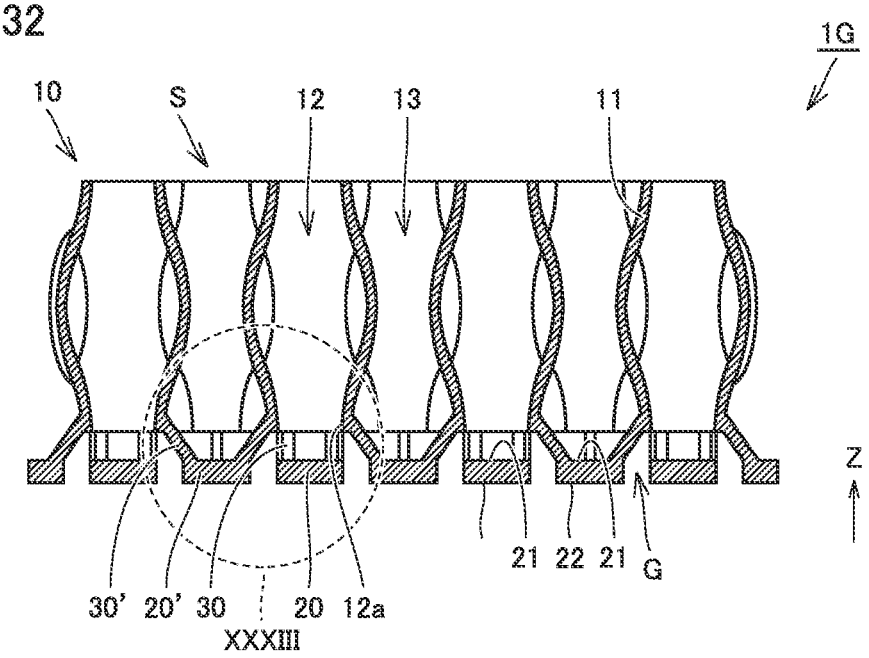
FIG. 32 is a cross section of the shock absorber shown in FIG. 30.
Figure 33:
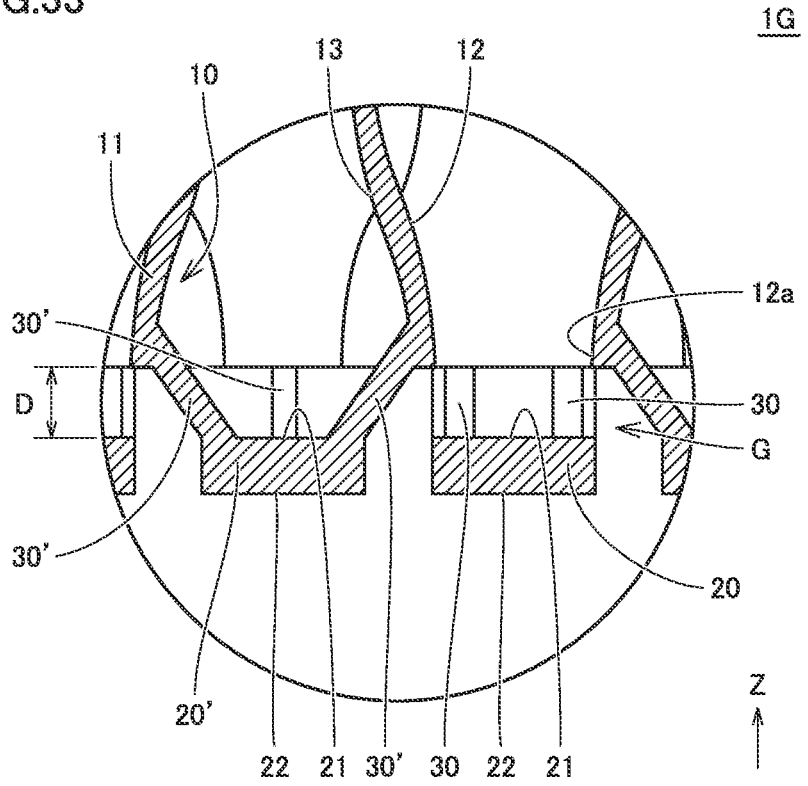
FIG. 33 is an enlarged cross section of a main portion of the FIG. 30 shock absorber.

FIG. 30 is a perspective view of a shock absorber according to a seventh embodiment. FIGS. 31A and 31B are bottom views of a shock absorbing portion of the shock absorber shown in FIG. 30, and FIG. 31A is a bottom view of the shock absorber with a cover portion removed (that is, a bottom view of the shock absorbing portion) and FIG. 31B is a general bottom view of the shock absorber including the shock absorbing portion and the cover portion. FIG. 32 is a cross section taken along a line XXXII-XXXII shown in FIG. 31B and FIG. 33 is an enlarged cross section of a region XXXIII shown in FIG. 32. Hereinafter, a shock absorber 1G according to the present embodiment will be described with reference to FIGS. 30 to 33. The shock absorber 1G according to the present embodiment is provided in the shoe sole 110 according to the first embodiment instead of the shock absorber 1A according to the first embodiment.

As shown in FIGS. 30 to 33, the shock absorber 1G according to the present embodiment differs from the shock absorber 1E according to the fifth embodiment in that the former is different in configuration in including an additional cover portion 20' and an additional columnar portion 30' in addition to the shock absorbing portion 10, the cover portion 20, and the columnar portion 30.

As shown in FIGS. 30, 31B, 32 and 33, the additional cover portion 20' is disposed at a position lower than the bottom surface of the shock absorbing portion 10, and the additional columnar portion 30' is positioned between the shock absorbing portion 10 and the additional cover portion 20' so as to interconnect the shock absorbing portion 10 and the additional cover portion 20'. The shock absorber 1G is a single member formed of the shock absorbing portion 10, the cover portion 20, the columnar portion 30, the additional cover portion 20' and the additional columnar portion 30' continuously connected together.

In the present embodiment, a single cover portion 20' is provided to correspond to four mutually adjacent unit structures U included in the shock absorbing portion 10 (including two unit structures adjacent to each other in the widthwise direction (i.e., the X direction) and two unit structures adjacent to each other in the depthwise direction (i.e., the Y direction), and four additional columnar portions 30' are provided to connect the corresponding set of the four unit structures U and the single cover portion 20'. Accordingly, a plurality of additional cover portions 20' will be disposed in a matrix so as to cover the plurality of second pass-through portions 13 provided at the bottom surface of the shock absorbing portion 10.

The plurality of additional cover portions 20' are each in the form of a disc, and each have an upper surface configured as the connected surface 21 (see FIG. 32 in particular) and a lower surface configured as the tread 22. The plurality of additional cover portions 20' each have a size that completely covers the corresponding pass-through portion 13.

The plurality of additional columnar portions 30' each extend downward from a peripheral edge of a lower end of each of the four unit structures U, and each have an end connected to a peripheral edge of the additional cover portion 20'. In the present embodiment, the plurality of additional columnar portions 30' are each configured to be generally in the form of a cylinder.

When the shock absorber 1G thus configured is viewed in the direction of the normal to the tread 22, the plurality of first pass-through portions 12 and the plurality of second pass-through portions 13 included in the shock absorbing portion 10 are all covered with the corresponding cover portions 20 and additional cover portions 20', respectively. Therefore, the plurality of first pass-through portions 12 and the plurality of second pass-through portions 13 are not directly, externally exposed in the direction of the normal to the tread 22, and a foreign matter immediately reaching inside the shock absorbing portion 10 will be avoided.

Thus a shoe sole comprising the shock absorber 1G according to the present embodiment and a shoe comprising the shoe sole can prevent a foreign matter from entering and inviting damage to the shock absorber 1G or deterioration thereof in performance.

Eighth Embodiment

Figure 34:
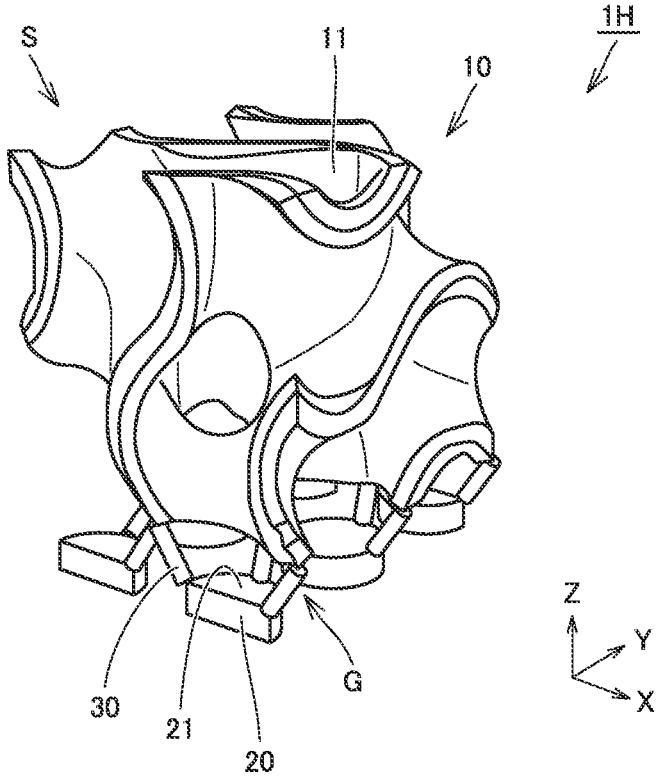
FIG. 34 is a perspective view of a shock absorber according to an eighth embodiment.

FIG. 34 is a perspective view of a shock absorber according to an eighth embodiment. A shock absorber 1H according to the present embodiment will be described below with reference to FIG. 34. The shock absorber 1H according to the present embodiment is provided in the shoe sole 110 according to the first embodiment instead of the shock absorber 1A according to the first embodiment.

As shown in FIG. 34, the shock absorber 1H according to the present embodiment is different from the shock absorber 1E according to the fifth embodiment only in the configuration of the shock absorbing portion 10. Specifically, the shock absorber 1H according to the present embodiment is configured such that the shock absorbing portion 10 has a three-dimensional structure S having a three-dimensional shape formed by the wall 11 having an external shape defined by a pair of parallel, geometrical curved surfaces, that is a gyroid structure with a thickness added thereto.

The shock absorbing portion 10 composed of the three-dimensional structure S that is a gyroid structure with a thickness added thereto will also be provided with a pass-through portion passing through the shock absorbing portion 10 due to its structure when viewed in the direction of the normal to the tread 22. The shock absorber 1H as shown has two unit structures aligned in each of the widthwise direction or the X direction and the depthwise direction or the Y direction, and has one unit structure disposed in the heightwise direction or the Z direction.

Thus, providing a plurality of cover portions 20 and a plurality of columnar portions 30 under the shock absorbing portion 10 and also causing the plurality of cover portions 20 to cover the above-described pass-through portions, as in the shock absorber 1H according to the present embodiment, can suppress intrusion of foreign matters into the shock absorbing portion 10 while reliably ejecting uncured resin in manufacturing the shock absorber.

Ninth Embodiment

Figure 35:
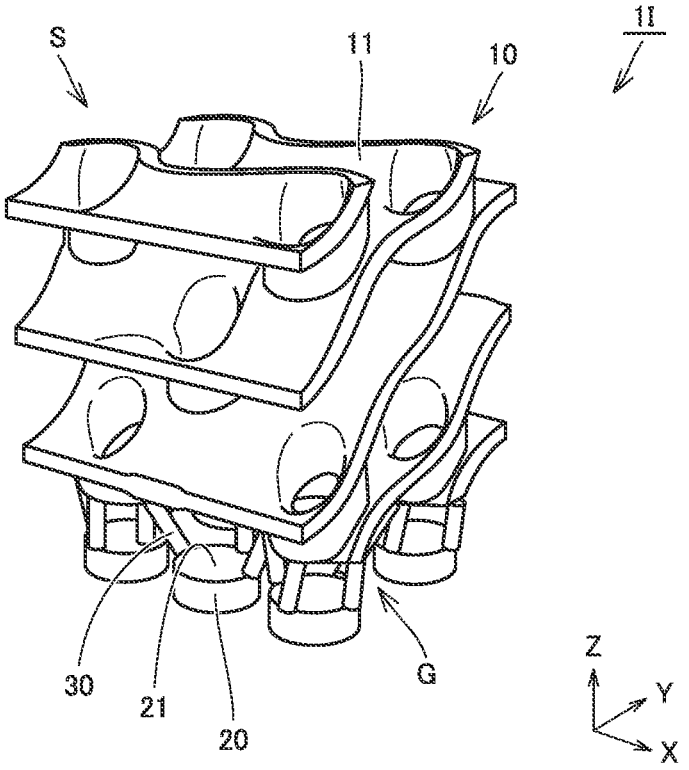
FIG. 35 is a perspective view of a shock absorber according to a ninth embodiment.

FIG. 35 is a perspective view of a shock absorber according to a ninth embodiment. A shock absorber 1I according to the present embodiment will be described below with reference to FIG. 35. The shock absorber 1I according to the present embodiment is provided in the shoe sole 110 according to the first embodiment instead of the shock absorber 1A according to the first embodiment.

As shown in FIG. 35, the shock absorber 1I according to the present embodiment is different from the shock absorber 1E according to the fifth embodiment only in the configuration of the shock absorbing portion 10. Specifically, the shock absorber 1I according to the present embodiment is configured such that the shock absorbing portion 10 has a three-dimensional structure S having a three-dimensional shape formed by the wall 11 having an external shape defined by a pair of parallel, geometrical curved surfaces, that is a Schwarz' D structure with a thickness added thereto.

The shock absorbing portion 10 composed of the three-dimensional structure S that is a Schwarz' D structure with a thickness added thereto will also be provided with a pass-through portion passing through the shock absorbing portion 10 due to its structure when viewed in the direction of the normal to the tread 22. The shock absorber 1I as shown has two unit structures aligned in each of the widthwise direction or the X direction and the depthwise direction or the Y direction, and has two unit structures disposed in the heightwise direction or the Z direction.

Thus, providing a plurality of cover portions 20 and a plurality of columnar portions 30 under the shock absorbing portion 10 and also causing the plurality of cover portions 20 to cover the above-described pass-through portions, as in the shock absorber 1I according to the present embodiment, can suppress intrusion of foreign matters into the shock absorbing portion 10 while reliably ejecting uncured resin in manufacturing the shock absorber.

Tenth Embodiment

Figure 36:
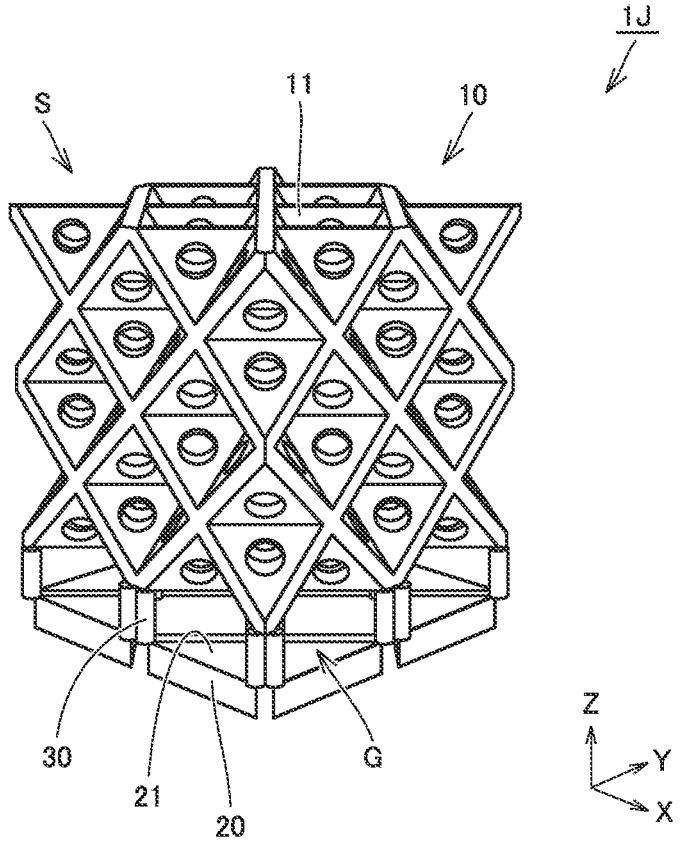
FIG. 36 is a perspective view of a shock absorber according to a tenth embodiment.

FIG. 36 is a perspective view of a shock absorber according to a tenth embodiment. A shock absorber 1J according to the present embodiment will be described below with reference to FIG. 36. The shock absorber 1J according to the present embodiment is provided in the shoe sole 110 according to the first embodiment instead of the shock absorber 1A according to the first embodiment.

As shown in FIG. 36, the shock absorber 1J according to the present embodiment is different from the shock absorber 1E according to the fifth embodiment only in the configuration of the shock absorbing portion 10. Specifically, the shock absorber 1J according to the present embodiment is configured such that the shock absorbing portion 10 is composed of a three-dimensional structure S having a three-dimensional shape formed by a wall 11 having an external shape defined by a pair of parallel, geometrical planes, and the three-dimensional structure S is formed of a plurality of planes disposed so as to intersect one another and provided with thickness such that the three-dimensional structure S is internally hollowed. The three-dimensional structure S shown is an octet structure with a thickness added thereto.

The shock absorbing portion 10 composed of the three-dimensional structure S that is an octet structure with a thickness added thereto requires providing the wall 11 with a hole passing through the wall 11 to eject uncured resin in manufacturing the shock absorber. Accordingly, the shock absorbing portion 10 will be provided with a pass-through portion passing through the shock absorbing portion 10 as viewed in the direction of the normal to the tread 22. The shock absorber 1J as shown has two unit structures disposed in each of the widthwise direction or the X direction, the depthwise direction or the Y direction, and the heightwise direction or the Z direction.

Thus, providing a plurality of cover portions 20 and a plurality of columnar portions 30 under the shock absorbing portion 10 and also causing the plurality of cover portions 20 to cover the above-described pass-through portions, as in the shock absorber 1J according to the present embodiment, can suppress intrusion of foreign matters into the shock absorbing portion 10 while reliably ejecting uncured resin in manufacturing the shock absorber.

Summary of Disclosure in Embodiments

The first to tenth embodiments and their variations disclose characteristic configurations, as summarized below:

A shoe sole according to an embodiment of the present disclosure at least partially comprises a shock absorber and is also provided with a tread. The shock absorber includes a shock absorbing portion composed of a three-dimensional structure composed of a unit structure repeatedly, regularly and successively disposed in at least one direction, the unit structure having a three-dimensional shape formed by a wall having an external shape defined by a pair of parallel planes or curved surfaces. The shock absorbing portion is provided with a plurality of pass-through portions passing through the shock absorbing portion as viewed in a direction of a normal to the tread. The shock absorber, as viewed in the direction of the normal to the tread, is provided with a cover portion that corresponds to at least one of the plurality of pass-through portions included in the shock absorbing portion and covers that pass-through portion. The shock absorber is formed of a single member formed with the shock absorbing portion and the cover portion continuously connected together. The tread is defined by a main surface of the cover portion that is located on a side opposite to a side where the shock absorbing portion is located, and the cover portion is provided with a communication path having one end open to the pass-through portion and the other end open at the tread. A shoe sole according to an embodiment of the present disclosure satisfies a condition of $R<L$, where R represents a diameter of a largest virtual incircle of a contour line of an opening of the communication path located closer to the tread, and L represents a length of the communication path in the direction in which the communication path extends.

In a shoe sole according to an embodiment of the present disclosure, the opening of the communication path located closer to the tread may have a shape which is not round.

In a shoe sole according to an embodiment of the present disclosure, the communication path may include a portion having a cross-sectional area decreasing from the side of the tread toward the side of the pass-through portion.

In a shoe sole according to an embodiment of the present disclosure, the communication path may include a portion having a cross-sectional area decreasing from the side of the pass-through portion toward the side of the tread.

In a shoe sole according to an embodiment of the present disclosure, the communication path may include a portion extending in a direction intersecting the direction of the normal to the tread.

In a shoe sole according to an embodiment of the present disclosure, the communication path may have the opening closer to the tread and that closer to the pass-through portion positioned such that they do not overlap each other as viewed in the direction of the normal to the tread.

A shoe sole according to another embodiment of the present disclosure at least partially comprises a shock absorber and is also provided with a tread. The shock absorber includes a shock absorbing portion composed of a three-dimensional structure composed of a unit structure repeatedly, regularly and successively disposed in at least one direction, the unit structure having a three-dimensional shape formed by a wall having an external shape defined by a pair of parallel planes or curved surfaces. The shock absorbing portion is provided with a plurality of pass-through portions passing through the shock absorbing portion as viewed in a direction of a normal to the tread. The shock absorber, as viewed in the direction of the normal to the tread, is provided with a cover portion that corresponds to at least one of the plurality of pass-through portions included in the shock absorbing portion and covers that pass-through portion, and a columnar portion that interconnects the shock absorbing portion and the cover portion. The shock absorber is formed of a single member formed with the shock absorbing portion, the columnar portion, and the cover portion continuously connected together. The tread is defined by a main surface of the cover portion that is located on a side opposite to a side where the columnar portion is located. A shoe sole according to another embodiment of the present disclosure has the pass-through portion in external communication via a gap formed by providing the columnar portion and the cover portion.

In a shoe sole according to an embodiment of the present disclosure and another aspect of the present disclosure, the three-dimensional structure may be configured by a triply periodic minimal surface with a thickness added thereto.

In a shoe sole according to an embodiment of the present disclosure and another aspect of the present disclosure, the three-dimensional structure may be composed of a plurality of planes disposed to intersect with one another and provided with thickness such that the three-dimensional structure is internally hollowed.

A shoe according to an embodiment of the present disclosure comprises the shoe sole according to an embodiment of the present disclosure as described above or another embodiment of the present disclosure as described above, and an upper provided above the shoe sole.

Other Embodiments

While in the first to tenth embodiments and their variations described above a shock absorber is disposed at a specific portion of a shoe sole in plan view for the sake of illustration, where the shock absorber is provided is not limited thereto. For example, depending on the type of the competition in which the shoe is used, how it is used, and the like, the shock absorber may be applied to a portion of the shoe sole on either one of the medial or lateral side or may be applied only at a partial region along an edge of the shoe sole (the partial region may be a plurality of such regions provided independently of one another). Alternatively, the shoe sole may not be provided with a midsole, and may instead entirely be composed of the shock absorber.

Furthermore, while in the first to tenth embodiments and their variations described above a shock absorber is composed of a three-dimensional structure that is a Schwarz' P structure, a gyroid structure, a Schwarz' D structure or an octet structure with a thickness added thereto by way of example, the present invention may be applied to a shock absorbing portion composed of any other three-dimensional structure.

Furthermore, while in the first to tenth embodiments and their variations described above the present invention is applied to a shoe comprising a tongue and a shoelace by way of example, the present invention may be applied to a shoe without these components (such as a shoe comprising a sock-shaped upper) and a shoe sole comprised by the shoe.

The characteristic configurations disclosed in the first to tenth embodiments and their variations can be combined with one another in a range that does not depart from the gist of the present invention.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A shoe sole comprising:

a shock absorber;

a midsole; and a tread, the shock absorber including a shock absorbing portion, the shock absorbing portion comprising a three-dimensional structure composed of a plurality of unit structures repeatedly, regularly and successively disposed in at least one direction, each unit structure having a three-dimensional shape configured by a wall having an external shape defined by a pair of parallel planes or curved surfaces, the shock absorbing portion having a plurality of pass-through portions passing through the shock absorbing portion as viewed in a direction normal to the tread, the shock absorber, as viewed in the direction normal to the tread, having a cover portion that corresponds to at least one of the plurality of pass-through portions included in the shock absorbing portion and covers that pass-through portion, the shock absorber being configured of a single member configured with the shock absorbing portion and the cover portion continuously connected together, the tread being defined by a main surface of the cover portion that is located on a side opposite to a side where the shock absorbing portion is located, the cover portion defining a communication path having one end open to the at least one covered pass-through portion and the other end open at the tread, the shoe sole satisfying a condition of $R<L$, where R represents a diameter of a largest virtual incircle of a contour line of an opening of the communication path located closer to the tread, and L represents a length of the communication path in a direction in which the communication path extends, the midsole having a notch in a lower portion thereof for accommodating the shock absorber between the midsole and the tread, and the shock absorber is bonded to the midsole such that an entirety of a top surface of the shock absorbing portion is covered by the midsole, including a topmost portion of each of the plurality of pass-through portions.

2. The shoe sole according to claim 1, wherein an opening of the communication path located closer to the tread has a non-round shape.

3. The shoe sole according to claim 2, wherein the three-dimensional structure is a triply periodic minimal surface with a thickness added thereto.

4. The shoe sole according to claim 1, wherein the communication path includes a portion having a cross-sectional area decreasing from a side of the tread toward a side of the pass-through portion.

5. The shoe sole according to claim 4, wherein the three-dimensional structure is a triply periodic minimal surface with a thickness added thereto.

6. The shoe sole according to claim 4, wherein the opening of the communication path located closer to the tread has a non-round shape.

7. The shoe sole according to claim 6, wherein the three-dimensional structure is a triply periodic minimal surface with a thickness added thereto.

8. The shoe sole according to claim 1, wherein the communication path includes a portion having a cross-sectional area decreasing from a side of the pass-through portion toward a side of the tread.

9. The shoe sole according to claim 8, wherein the three-dimensional structure is a triply periodic minimal surface with a thickness added thereto.

10. The shoe sole according to claim 8, wherein the opening of the communication path located closer to the tread has a non-round shape.

11. The shoe sole according to claim 10, wherein the three-dimensional structure is a triply periodic minimal surface with a thickness added thereto.

12. The shoe sole according to claim 1, wherein the communication path includes a portion extending in a direction intersecting the direction normal to the tread.

13. The shoe sole according to claim 12, wherein the communication path has the opening closer to the tread and an opening closer to the pass-through portion positioned such that they do not overlap each other as viewed in the direction of the normal to the tread.

14. The shoe sole according to claim 1, wherein the three-dimensional structure is a triply periodic minimal surface with a thickness added thereto.

15. The shoe sole according to claim 1, wherein the three-dimensional structure is composed of a plurality of planes disposed to intersect with one another and having a thickness such that the three-dimensional structure is internally hollowed.

16. A shoe comprising:

the shoe sole according to claim 1; and an upper provided above the shoe sole.

17. The shoe sole according to claim 1, wherein each respective one of the plurality of pass-through portions is located inside a corresponding one of the plurality of unit structures.

* * * * *